US012495878B2

(12) United States Patent
Park et al.

(10) Patent No.: US 12,495,878 B2
(45) Date of Patent: Dec. 16, 2025

(54) HAIRSTYLING APPARATUSES AND RELATED METHODS

(71) Applicant: Kiss Nail Products, Inc., Port Washington, NY (US)

(72) Inventors: SungLyul Park, Seoul (KR); Robert Kim, Tuxedo, NY (US); Siyong Sung, Roslyn Heights, NY (US); Taehoon Kim, Huntington Station, NY (US); GuangNam Kim, Seoul (KR)

(73) Assignee: Kiss Nail Products, Inc., Port Washington, NY (US)

( * ) Notice: Subject to any disclaimer, the term of this patent is extended or adjusted under 35 U.S.C. 154(b) by 173 days.

(21) Appl. No.: 18/182,311

(22) Filed: Mar. 10, 2023

(65) Prior Publication Data

US 2023/0200510 A1 Jun. 29, 2023

Related U.S. Application Data

(63) Continuation-in-part of application No. 17/947,894, filed on Sep. 19, 2022, now Pat. No. 12,232,595,
(Continued)

(51) Int. Cl.
*A45D 6/00* (2006.01)
*A45D 1/04* (2006.01)
(Continued)

(52) U.S. Cl.
CPC ..... *A45D 6/02* (2013.01); *A46B 9/023* (2013.01); *A46B 9/12* (2013.01); *A46B 15/003* (2013.01);
(Continued)

(58) Field of Classification Search
CPC ... A45D 6/02; A45D 1/18; A45D 1/16; A45D 6/04; A45D 1/04; A46B 9/023;
(Continued)

(56) References Cited

U.S. PATENT DOCUMENTS 1,411,817 A * 4/1922 Torrent ..... A45D 1/18 132/225
1,429,167 A 9/1922 Scharer
(Continued)

FOREIGN PATENT DOCUMENTS

CN 2770438 Y 4/2006
CN 101896091 11/2010
(Continued)

OTHER PUBLICATIONS

Evaluation Report of Utility Model Patent No. ZL2014201064595, dated Jun. 4, 2015.
(Continued)

*Primary Examiner* — Catherine S Williams
(74) *Attorney, Agent, or Firm* — Cherskov Flaynik & Gurda, LLC

(57) ABSTRACT

A hairstyling apparatus is shown. The apparatus includes a heated barrel with a central axis. R also includes a heating element connected with the barrel and a hair styling tool extending along a longitudinal length of the hairstyling surface and configured to rotate around the central axis of the barrel, the hairstyling tool including a comb portion comprising a plurality of bristles that protrude in a direction away from the hairstyling surface and a grooved portion comprising a plurality of grooves that expose the hairstyling surface.

20 Claims, 35 Drawing Sheets

Related U.S. Application Data which is a continuation-in-part of application No. 17/355,103, filed on Jun. 22, 2021, now Pat. No. 11,457,712, which is a continuation-in-part of application No. 16/943,159, filed on Jul. 30, 2020, now Pat. No. 11,224,274, which is a continuation-in-part of application No. 16/111,970, filed on Aug. 24, 2018, now Pat. No. Re. 48,170, which is an application for the reissue of Pat. No. 10,010,147, which is a continuation-in-part of application No. 14/980,280, filed on Dec. 28, 2015, now Pat. No. 10,117,488.

(51) Int. Cl.

| | |
|---|---|
| ***A45D 1/18*** | (2006.01) |
| ***A45D 6/02*** | (2006.01) |
| ***A46B 9/02*** | (2006.01) |
| ***A46B 9/12*** | (2006.01) |
| ***A46B 15/00*** | (2006.01) |
| ***A46D 1/00*** | (2006.01) |
| *A45D 1/00* | (2006.01) |
| *A45D 1/12* | (2006.01) |
| *A45D 1/28* | (2006.01) |

(52) U.S. Cl.
CPC ..... *A46D 1/0284* (2013.01); *A46B 2200/104* (2013.01)

(58) Field of Classification Search
CPC ... A46B 9/12; A46B 15/003; A46B 2200/104; A46D 1/0284
See application file for complete search history.

(56) References Cited

U.S. PATENT DOCUMENTS

| | | | | |
|---|---|---|---|---|
| 1,623,758 | A | 4/1927 | Santurello | |
| 1,652,279 | A | 12/1927 | Jacobs | |
| 1,661,747 | A | 3/1928 | Capdevila | |
| 1,662,411 | A | 3/1928 | Bonat | |
| 1,763,655 | A | 6/1930 | Ingrassia | |
| RE17,832 | E | 10/1930 | Borden | |
| 1,815,266 | A | 7/1931 | Mack | |
| 1,824,497 | A | 9/1931 | Percell | |
| 1,901,430 | A | 3/1933 | Bjorkman | |
| 2,424,815 | A | 7/1947 | Grant | |
| 2,454,558 | A | 11/1948 | Kleinsmith | |
| 2,527,218 | A | 10/1950 | Heaton | |
| 2,788,006 | A | 4/1957 | Trabish | |
| 3,057,363 | A | 10/1962 | Talbot | |
| 3,105,503 | A | 10/1963 | Safianoff | |
| 3,859,497 | A | 1/1975 | McNair | |
| 3,890,984 | A | 6/1975 | Lesetar | |
| 3,918,465 | A | 11/1975 | Barradas | |
| 4,023,578 | A | 5/1977 | Buhler | |
| 4,024,375 | A | 5/1977 | Olesen | |
| 4,177,824 | A | 12/1979 | Gnaga | |
| 4,233,999 | A | 11/1980 | Thomas | |
| 4,267,431 | A | 5/1981 | Rick | |
| 4,267,851 | A | 5/1981 | Plaisted | |
| 4,314,137 | A | 2/1982 | Dorn | |
| 4,329,567 | A | 5/1982 | Kunz | |
| 4,419,565 | A | 12/1983 | McGaw | |
| 4,443,688 | A | 4/1984 | Andis | |
| 4,456,815 | A | 6/1984 | Andis | |
| 4,468,554 | A | 8/1984 | Andis | |
| 4,469,934 | A | 9/1984 | Isshiki | |
| 4,473,086 | A | 9/1984 | Thaler | |
| 4,593,708 | A | 6/1986 | Goeller | |
| 4,641,010 | A | 2/1987 | Abura | |
| 4,656,684 | A * | 4/1987 | Jewett | A45D 6/04 15/187 |
| 4,664,132 | A | 5/1987 | Schillig | |
| 4,829,156 | A | 5/1989 | Robert | |
| 4,866,248 | A | 9/1989 | Altamore | |
| 4,953,574 | A | 9/1990 | Tsuji | |
| 5,046,516 | A | 9/1991 | Barradas | |
| 5,091,630 | A | 2/1992 | Djuric | |
| 5,186,188 | A | 2/1993 | Fasolt | |
| 5,191,907 | A | 3/1993 | Hirzel | |
| 5,365,037 | A | 11/1994 | Chan | |
| 5,400,810 | A | 3/1995 | Taylor | |
| 5,513,665 | A | 5/1996 | Chan | |
| 5,558,107 | A | 9/1996 | Kim | |
| 5,673,710 | A * | 10/1997 | Schaefer | A46B 15/0002 132/229 |
| 5,765,575 | A | 6/1998 | Denebeim | |
| 6,554,000 | B2 | 4/2003 | Lin | |
| 6,627,852 | B1 | 9/2003 | Savone | |
| 7,271,368 | B2 | 9/2007 | Yeung | |
| 8,132,571 | B1 | 3/2012 | Jackson | |
| 8,539,964 | B2 | 9/2013 | Rong | |
| 8,646,465 | B2 | 2/2014 | Tam | |
| 9,185,957 | B2 | 11/2015 | Richmond | |
| 10,010,147 | B2 | 7/2018 | Lee | |
| 2003/0052115 | A1 | 3/2003 | Leung | |
| 2005/0172980 | A1 | 8/2005 | Julemont | |
| 2005/0252521 | A1 | 11/2005 | Leblanc | |
| 2006/0237418 | A1 | 10/2006 | Bousfield | |
| 2007/0175881 | A1 | 8/2007 | Yeung | |
| 2007/0278205 | A1 | 12/2007 | Pencook | |
| 2010/0083978 | A1 | 4/2010 | Hottenrott | |
| 2010/0263684 | A1 | 10/2010 | De Benedictis | |
| 2011/0284020 | A1 | 11/2011 | Tam | |
| 2012/0111354 | A1 | 5/2012 | Cafaro | |
| 2012/0145180 | A1 | 6/2012 | Rong | |
| 2013/0025621 | A1 | 1/2013 | De Benedictis | |
| 2013/0068245 | A1 | 3/2013 | De Benedictis | |
| 2013/0125919 | A1 | 5/2013 | De Benedictis | |
| 2013/0263882 | A1 | 10/2013 | Kim | |
| 2013/0263883 | A1 | 10/2013 | Story | |
| 2014/0076348 | A1 | 3/2014 | Deng | |
| 2014/0366909 | A1 | 12/2014 | Richmond | |
| 2016/0206070 | A1 * | 7/2016 | Han | A45D 1/04 |

FOREIGN PATENT DOCUMENTS

| | | | |
|---|---|---|---|
| CN | 101896091 B | 11/2010 | |
| CN | 201958032 | 9/2011 | |
| CN | 102711549 | 10/2012 | |
| CN | 102783803 | 11/2012 | |
| CN | 202680933 | 1/2013 | |
| CN | 202722897 | 2/2013 | |
| CN | 203207435 | 9/2013 | |
| CN | 104366944 | 2/2015 | |
| CN | 204336124 | 5/2015 | |
| CN | 204670560 | 9/2015 | |
| DE | 8206841 | 7/1982 | |
| DE | 4312453 | 10/1994 | |
| EP | 0057094 | 8/1982 | |
| EP | 0571389 | 6/1996 | |
| EP | 2622989 | 8/2013 | |
| EP | 2392222 | 9/2013 | |
| FR | 1327927 | 5/1963 | |
| FR | 2879415 | 6/2006 | |
| GB | 1530360 | 10/1978 | |
| GB | 2277261 | 10/1994 | |
| JP | 3185229 | 8/2013 | |
| JP | 3988960 | 8/2013 | |
| KR | 20020015082 | 2/2002 | |
| KR | 101166913 | 7/2012 | |
| KR | 101263801 | 5/2013 | |
| KR | 101326212 | 11/2013 | |
| KR | 20170003804 U | 11/2017 | |
| WO | WO-9807345 A1 * | 2/1998 | A45D 1/04 |
| WO | 2011124137 | 10/2011 | |

OTHER PUBLICATIONS

Sedu Revolution Clipless Curling Iron, Folica, http://www.folica.com/tools/curling-irons/sedu-revolution-clipliss-curling-iron, (Screenshot taken on Nov. 25, 2013).

(56) References Cited

OTHER PUBLICATIONS

Cortex 4-in-1 Ceramic Clipless Curling Iron Set, Folica, http://www.folica.com/tools/curling-irons/cortex-professional-4-in-1-ceramic-clipless-curling-iron-se:#tab=overview, (Screenshot taken on Nov. 25, 2013).
3/4 Clipless Curling Iron—19mm—Turquoise, Brilliance New York, http://www.brilliancenewyork.com/product/34-clipless-curling-iron-19mm-turtouise/./ (Screenshot taken on Nov. 25, 2013).
International Search Report dated Feb. 4, 2015 of International Application No. PCT/US2014/064082 (3 pages).
Written Opinion dated Feb. 4, 2015 of International Application No. PCT/US2014/064082 (6 pages).
Japanese Office Action dated Jul. 14, 2015 of Japanese Application No. 2014-134312.
Communication Pursuant to EPC Article 94(3) dated Feb. 7, 2018 for European Application No. 17201455.7.
Extended European Search Report Dated Feb. 7, 2018 for European Application No. 17201455.7.
Examination Notice dated Feb. 7, 2018 for Taiwanese Application No. 106106308.
Notification of Second Chinese Office Action Dated Jul. 3, 2018, for Chinese Patent Application No. 201410084698.X.
Cortex Clipless Curling Iron, Folica, http://www.folica.com/tools/curling-irons/cortex-clipless-curling-iron#tab=overview, as viewed on the Way Way Back Machine dated May 7, 2013, https://web.archive.org/web/20130612074603/http://m.folica.com/tools/curling-irons/cortex-clipless-curling-iron.
Communication Pursuant to EPC Article 94(3) dated Feb. 6, 2018 for European Application No. 14860385.5.

* cited by examiner

HAIRSTYLING APPARATUSES AND RELATED METHODS

PRIORITY

This application claims priority as a Continuation-In-Part of U.S. patent application Ser. No. 17/947,894, filed on Sep. 19, 2022, presently pending, which claim priority as a Continuation-In-Part of U.S. patent application Ser. No. 17/355,103, filed on Jun. 22, 2021, issued as U.S. Pat. No. 11,457,712 on Oct. 4, 2022. Application Ser. No. 17/355,103, in turn, claimed priority as a Continuation-In-Part of U.S. patent application Ser. No. 16/943,159, filed on Jul. 30, 2020, issued as U.S. Pat. No. 11,224,274 on Jan. 18, 2022. Application Ser. No. 16/943,159 was, in turn, a Continuation-In-Part of U.S. patent application Ser. No. 16/111,970, filed on Aug. 24, 2018, issued as U.S. Pat. No. RE48,170 on Aug. 25, 2020, which was a reissue application of U.S. patent application Ser. No. 15/076,065, filed on Mar. 21, 2016, patented as U.S. Pat. No. 10,010,147 on Jul. 3, 2018, which is a continuation-in-part of U.S. patent application Ser. No. 14/980,280 filed on Dec. 28, 2015, patented as U.S. Pat. No. 10,117,488 on Nov. 6, 2018, the contents of which are all hereby incorporated by reference.

BACKGROUND OF THE INVENTION

1. Field of the Invention

This disclosure generally relates to hairstyling apparatuses, and more specifically, to hair curling apparatuses and related methods.

2. Background of the Invention

Heated styling irons (e.g., curling irons) are used to form hair to a wide variety of styles, such as curling hair to impart a curl that does not naturally occur or straightening hair to remove a kink or curl. Circular or semicircular-shaped curls can be created by wrapping hair around the outer surface of a heated cylindrically shaped curling iron.

Conventional curling irons include a cylindrical curling surface having a clamping member that fits about a portion of the surface. During use, the curling mandrel can be heated. A mass of hair is clamped against the surface by the clamping member and curled by rotating the surface. Heat applied to the surface can alter the texture of the hair so as to curl it. After a predetermined amount of time, the clamping member is disengaged from the surface, and the curled hair is released. A disadvantage of such clamping configurations includes uneven distribution of hair under the clamp. The end of the hair often dislodges or slips from under the clamp. Another disadvantage is that the hair, which may be combed out before curling, is now bunched up again. Usually, curling operations using clamps is a two-handed procedure. This can be hard on the user's wrists.

Some conventional devices include a motorized heated surface to wind hair around the heated surface automatically. However, these motorized devices do not provide a means for maintaining precombed hair. For example, many of these motorized devices include a clamp to reversibly anchor hair to the heated surface at the beginning of winding. However, the user needs to move the motorized and heated curling iron toward her scalp and/or face as the barrel rotates.

State-of-the-art devices without a clamp are inefficient in holding the hair at the right angle or in the right amount such that sufficient heat cannot be imparted to the hair to affect a curl.

A need exists in the art for a system that can simplify hair curling. A need also exists for a system and method to create more naturally and evenly curled hair while the hair may be in a combed state. The system and method should allow for simultaneous hair curling and combing in a single-handed operation, particularly without the clamps mentioned above of state-of-the-art systems.

SUMMARY OF INVENTION

An object of the present invention is to provide a device and method for curling hair that overcomes the drawbacks of the state of the art tools.

Another object of the invention is to provide a device and method for simultaneously curling and combing hair. A feature of the invention is that no clamp exists or is required to curl the hair about a heated cylindrical surface. As such, the heating surface of the device is not overlaid by a clamp or any other structure, and therefore the entire heating surface is accessible. An advantage of the invention is that any amount of hair or thickness of hair may be both curled and combed simultaneously, and with one hand operation. Another advantage is that the hair is prevented from tangling.

Still another object of the invention is to provide a device that styles hair more efficiently. A feature of the invention is that comb teeth extend towards a hairstyling surface without contacting the hairstyling surface. Another feature is the incorporation of medially extending, thermally conductive, or non-conductive blades, the latter of which may be rigid or reversibly deformable (i.e., a non-rigid material). An advantage of the invention is that the medially extending combs and blades press the hair against the hairstyling surface for a time and at a pressure to allow heat from the hairstyling surface to transfer to the hair.

Still another object of the invention is to provide a device and method for combining several hair styling operations into one system. A feature of the invention is that an elongated rotating surface of an apparatus is in close spatial relationship to one or more axially extending members, each of the members having a first end, also referred to as the proximal end, attached to a rotating plate and a second end, which is the distal end which may or may not contact the surface. Another feature of the invention is that each of one or more of the axially extending members may be overlaid with a comb or a blade. An advantage of the invention is that it simultaneously combs, curls, and heats the hair, all without the need for a clamp seen in prior art systems, all in a one-handed operation. This results in shorter styling time and, therefore, healthier hair.

An object of the invention is to provide a versatile device for curling and otherwise styling hair adapted for single-handed use. A feature of the device is a heated, longitudinally-extending barrel that can be stationary or rotating. An advantage of the invention is that radially protruding members such as combs and other protuberances are removably spaced from each other, and the barrel to not interfere with each other. This is particularly helpful when styling forehead hair or "bangs," during which the device is held horizontally.

Another object of the invention is to provide a hairstyling apparatus for adding lift and increasing volume as well as imparting a curl to the hair. A feature of the apparatus is a hair styling tool extending along a longitudinal length of the hairstyling surface and configured to rotate around the central axis of the barrel, the hairstyling tool including a comb portion comprising a plurality of bristles that protrude in a direction away from the hairstyling surface and a grooved portion comprising a plurality of grooves that expose the hairstyling surface.

Briefly, the details described herein relate to a hairstyling apparatus including: a barrel defining a hairstyling surface and a central longitudinal axis, wherein the barrel has a first proximal end and a second distal end; a heating element in thermal communication with the barrel; a rotating member located at the proximal end of the barrel and configured to rotate around the central axis of the barrel, the rotating member including at least one tab extending along a longitudinal length of the hairstyling surface over at least a portion of a longitudinally extending portion of the hairstyling surface; and at least one hairstyling element received in said at least one tab.

In some aspects, the techniques described herein relate to a method of styling hair, the method including: providing a hairstyling apparatus having a barrel defining a hairstyling surface and a central longitudinal axis, wherein the barrel has a first proximal end and a second distal end and the apparatus further including a rotating member at a proximal end of the barrel wherein said rotating member is configured to rotate around the central axis of the barrel; energizing a heating element in thermal communication with the barrel; directing hair around the barrel and towards the rotating member having at least one tab; redirecting hair using the at least one tab extending along a longitudinal length of the hairstyling surface over at least a portion of a longitudinally extending portion of the hairstyling surface; and exposing hair to the heated barrel hairstyling surface while curling the exposed hair.

BRIEF DESCRIPTION OF THE DRAWINGS

The invention, together with the above and other objects and advantages, will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings. While some of the figures depict a person or a face of a person, the invention does not incorporate a human being, but rather the figures include a person for context and to provide details of use of one embodiment. The person is not part of the technical description, but rather an illustration of the context in which the hairstyling tool is intended to be used.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invention provides hair curling devices that include a rotating member configured to wrap hair around a generally stationary heated barrel. Other embodiments of the invention include the use of a rotating heated barrel.

A feature of the invention is that the hairstyling apparatus includes a rotating member which comprises an axially-extending tab or protuberance, and a comb which is attached to the tab and comprises a plurality of teeth arranged along the longitudinal axis α of the hairstyling surface, wherein the teeth extend in a direction at an angle Ø from the longitudinal axis α. This allows the hair to be more evenly along the tab.

Generally, the hair is contacted with an elongated, stationary or rotating member. A distal end of the member terminates in at least one longitudinally extending tab or protuberance. In instances where more than one protuberance is present, the protuberances are spaced apart from each other along an arc defining a distal periphery of the rotating member. The protuberances may be symmetrically spaced with each other so as to catch approximately the same amount of hair. This would cause a more even winding of the hair about the surface of a heated barrel, described infra. However, asymmetric positioning of the tabs will still result in catching and winding of the hair. The aforementioned tabs are positioned radially from the barrel so as to provide a space between the tab(s) and the hairstyling surface to allow catching of hair caught by the tab, so also to prevent the hair from being compressed and trapped against the surface for an over-extended period. This open configuration (compared to a clamping curler, for example) also provides the option for one or more of the tabs to be overlaid with a comb, fluid-filled micro-applicator, etc.

Figure 1A:
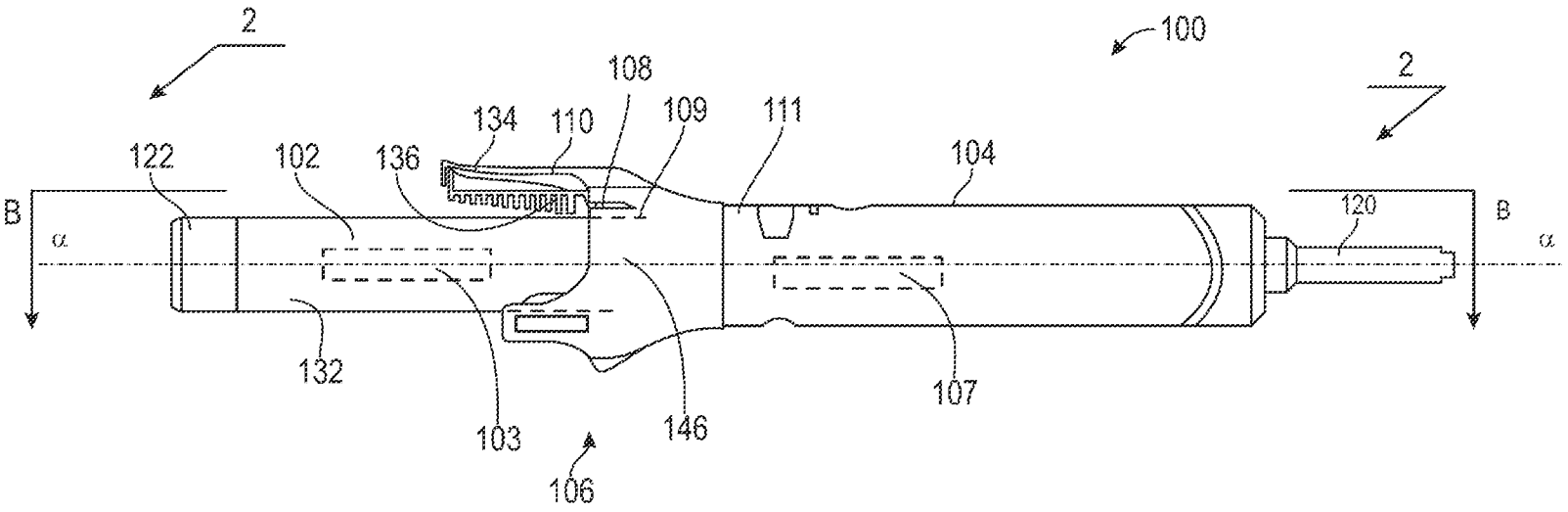
FIG. 1A depicts a side view of a hair curling device with a rotating member, in accordance with features of the present invention.
Figure 2A:
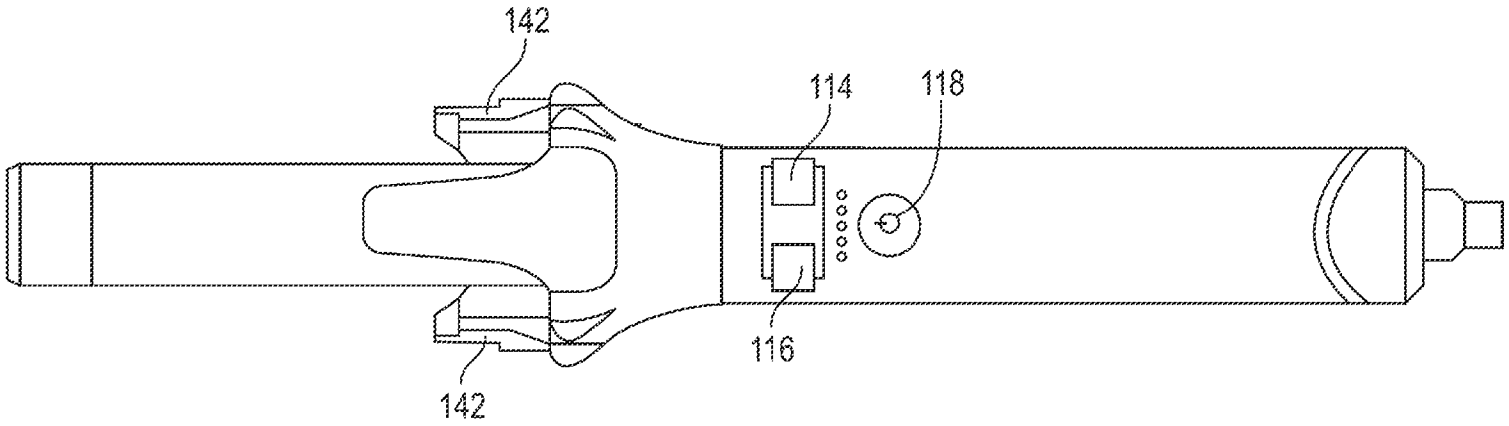
FIG. 2A depicts a view of FIG. 1A, taken along line 2-2.
Figure 3A:
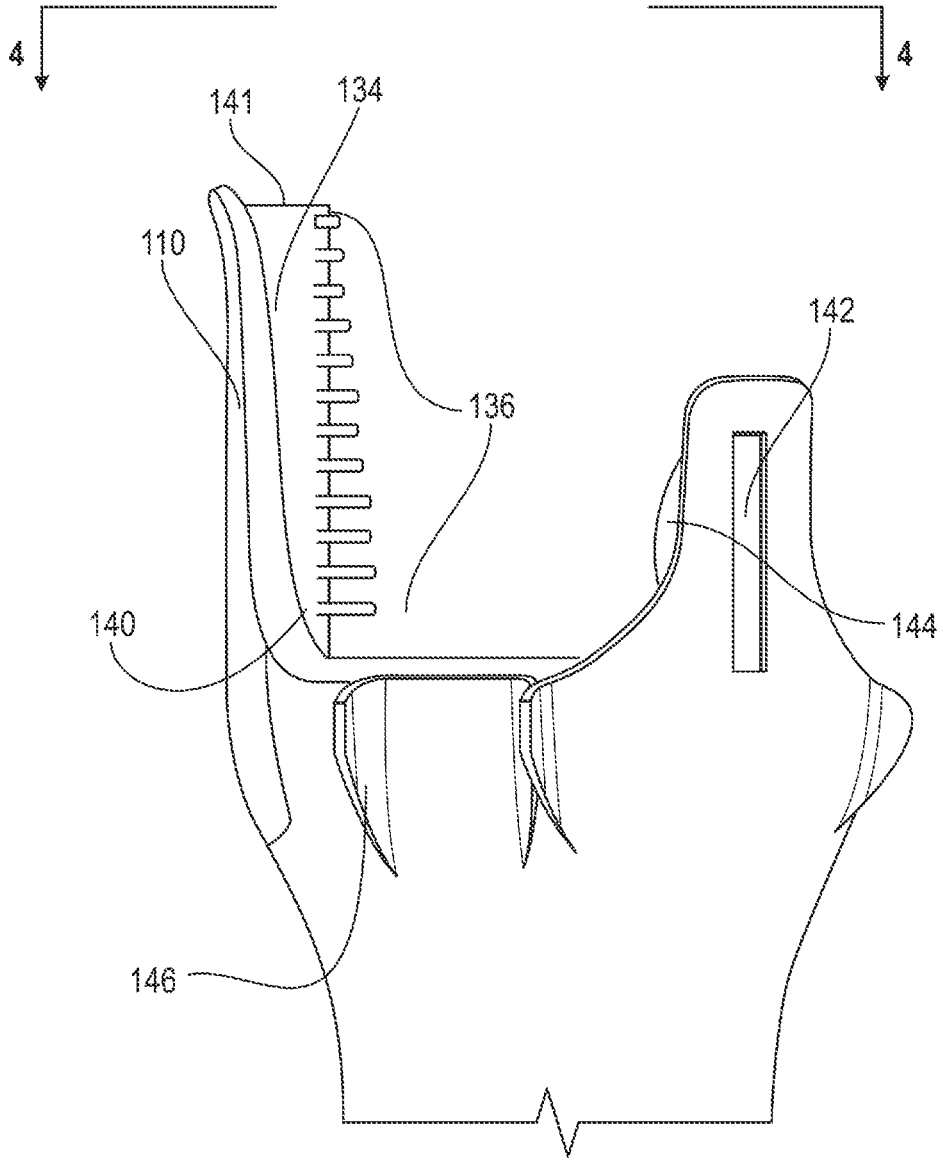
FIG. 3A depicts a side view of an exemplary rotating member.
Figure 4:
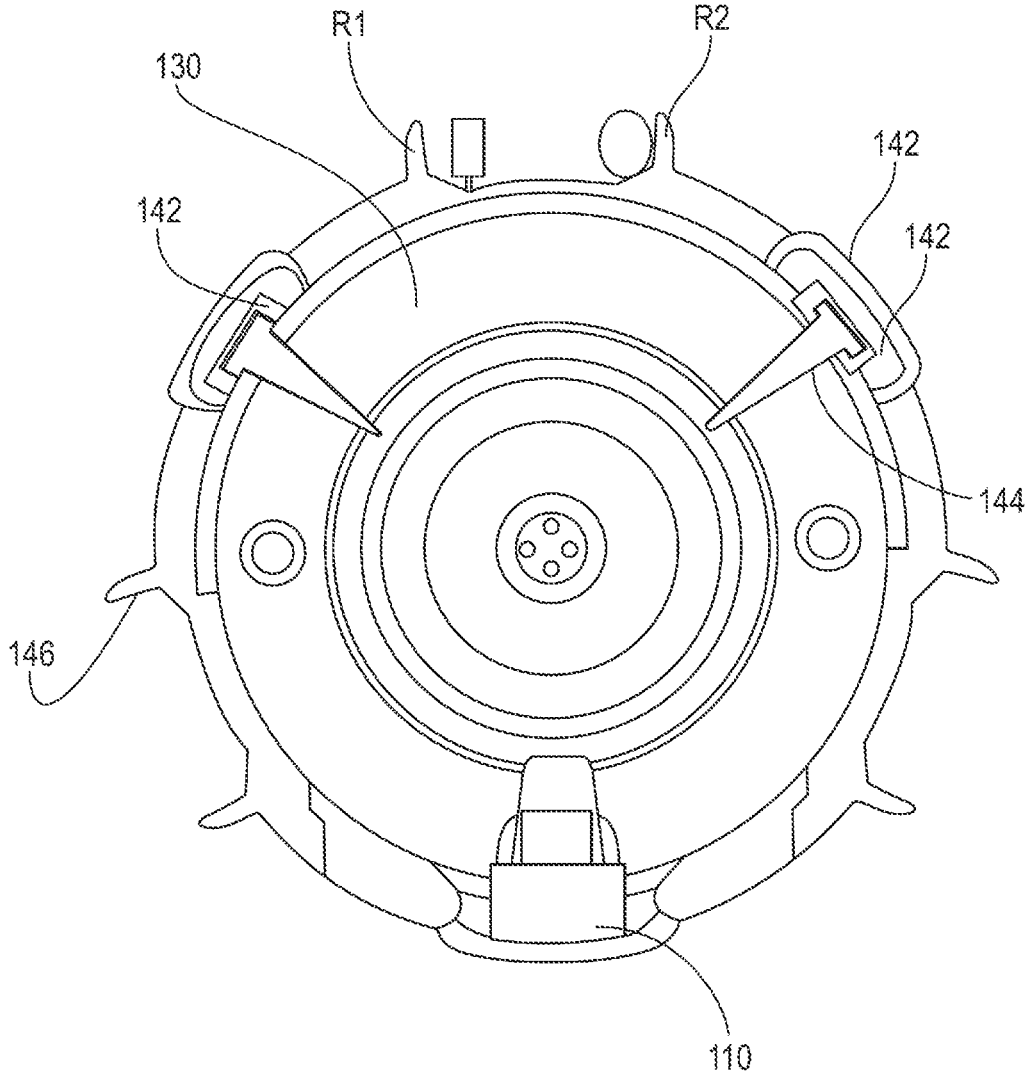
FIG. 4 is a view of FIG. 3A, taken along line 4-4.

FIG. 1A depicts an elevational view of an example hair curling device having a rotating member to curl hair around a heated barrel. (As described infra, the barrel may or may not also be rotating.) FIG. 2A depicts a top view of the example hair curling device shown in FIG. 1A. FIG. 3A depicts a side view of an exemplary rotating member. FIG. 4 depicts a view of the example rotating member shown in FIG. 3A viewing from line 4-4.

As shown in FIG. 1A, a hairstyling apparatus 100 (suitable for imparting curls to hair) includes a heated cylindrical surface such as a generally cylindrical barrel 102. A first proximal end 109 of the barrel is coupled to a distal end 111 of a handle 104 (the handle acts as a housing for various components). The proximal end of the handle 104 terminates in a power cord 120, or an electrical charging port in the case of cordless versions of the device. The longitudinal axis of the barrel is coaxial with the longitudinal axis of the housing.

The barrel 102 defines a hairstyling surface 132 that in one embodiment does not rotate relative to (e.g., is not rotatably coupled to) the handle 104. Rather the surface 132 provides an immobile cylindrically shaped surface around which hair can be wrapped and heated to create curls. The barrel 102 generally defines the aforementioned first proximal end 109 (shown in phantom dashed lines), a second distal end terminating in a heat insulating tip 122, and a longitudinally extending surface between its two ends.

The barrel 102 typically includes a heating element 103 (e.g., a ceramic heating element), schematically shown in FIG. 1 in phantom, configured to heat at least a portion of the barrel 102, such as the overlaying hairstyling surface 132, to curl a user's hair. The heating element 103, shown in the drawing as being positioned approximately midway between the first and second ends of the barrel, and may be encapsulated by the barrel 102 so as to be positioned below the barrel's surface 132. This position prevents the heating element from physically contacting the hair or the scalp, and therefore overheating those structures. In such a configuration, the surface 132 is heated by the heating element 103 via thermal conduction.

A heat selection switch 118 (shown in FIG. 2A) can be arranged along the handle, which is configured to enable one-handed operation to turn the device on or off and to select between one of several different heat settings, such as a high-temperature setting and a low-temperature setting. In the embodiment shown, the heat selection switch 118 is positioned proximal to the distal end 111 of the handle.

The barrel 102 is typically formed of a thermally conductive yet resilient material, such as a metal selected from the group consisting of aluminum, iron, steel, silver, their alloys, and combinations thereof. The thermally conductive yet resilient material is surrounded (e.g., coated or wrapped) with a material that is less thermally conductive than the barrel (e.g., a thermally non-conductive material) so as to prevent or minimize damage to the hair. Such less thermally conductive material may be a nonmetallic material selected from the group consisting of ceramic, glass, stone (e.g., Tourmaline), and combinations thereof.

The barrel 102 can be formed in various widths (e.g., diameters) based on the intended curls desired by the user. In some embodiments, the barrel 102 can have a cross-section or diameter that is about 0.375 inches to about 2.5 inches. Exemplary diameters range from about 0.5 inches to about 1.5 inches. In the example illustrated, the barrel 102 has a diameter of approximately 1 inch.

The aforementioned heat insulated cooling tip 122 is disposed at the free, exposed, second distal end of the barrel 102. In some embodiments, the free distal end of the barrel is disposed opposite the handle. The cooling tip 122 can help to reduce the likelihood that the user will burn themselves with the barrel 102, for example, by creating a physical barrier between the end of the barrel 102 and the user's head.

The free, exposed end of the styling device, comprising the exposed, distal end of the barrel, is typically free of hair-snagging housings or enclosures. That is, the free end of the barrel is typically unenclosed and open to the surrounding environment so that hair can be more easily captured and wrapped around the hairstyling surface. The resulting curled hair is then more easily slid toward the distal end of the device for removal. Otherwise, such housing or enclosures could create an obstruction that may make it more difficult for a user to easily remove hair from the styling device. For example, hair could get wound around one or more surfaces within any confines created by such an enclosure.

Figure 1B:
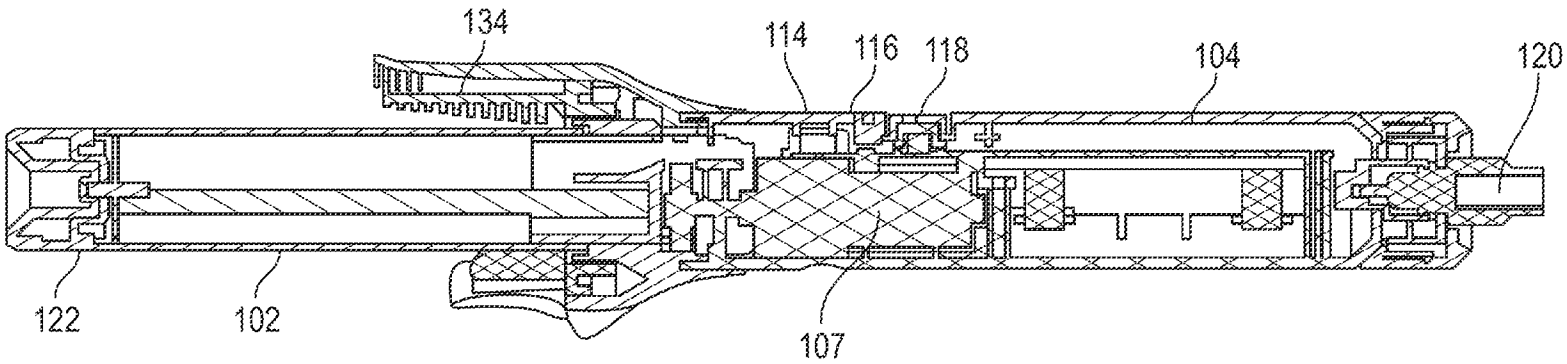
FIG. 1B is a cutaway view of FIG. 1A taken along line B-B.

FIGS. 1A and 1B show an embodiment of the device wherein the entire tip 122 and at least the distal half of the barrel 102 axially extends beyond the distal end of any comb member 134 or protruding members 142 (in the shape of a tab) peripherally arranged about the proximal end of the barrel.

In some embodiments, at least a portion of the cooling tip has a width (e.g., diameter) that is larger than the barrel 102 to help keep the user from accidentally placing the sides of the barrel 102 on their head. The distal end of the larger diameter region may terminate in a radially extending flange, plate, wall, or similar barrier (not shown) to prevent hair from slipping off the end of the barrel.

A rotating member 106 is positioned between the first proximal end 109 of the barrel and the second distal end 111 of the handle 104. The rotating member 106 is shown as a sleeve on the barrel. The rotating member 106 is rotatable relative to the hairstyling surface 132 of the barrel 102 and typically also the handle 104 as the handle 104 and the barrel 102 can be coupled to one another. As such, the rotating member is in rotating communication with the barrel and the handle.

In addition, the barrel 102 may rotate instead of the rotating member 106, or in conjunction with the rotating member 106. Further, the barrel 102 may rotate at the same speed (e.g., RPMs) as the rotating member 106 or at a different speed. For example, the barrel revolution rate may be slightly less than the rotating member rate so as to provide a more gradual curl to the hair, depending on user preference.

As shown schematically in FIGS. 1A and 1B, a drive motor 107, which can be mounted in the handle 104 (e.g., in a motor holding chassis) is configured to rotate the rotating member 106 relative to the handle 104 and the barrel 102. As such, both the handle and barrel remain motionless. Alternatively, the drive motor rotates the barrel 102 relative to the rotating member 106.

Figure 1C:
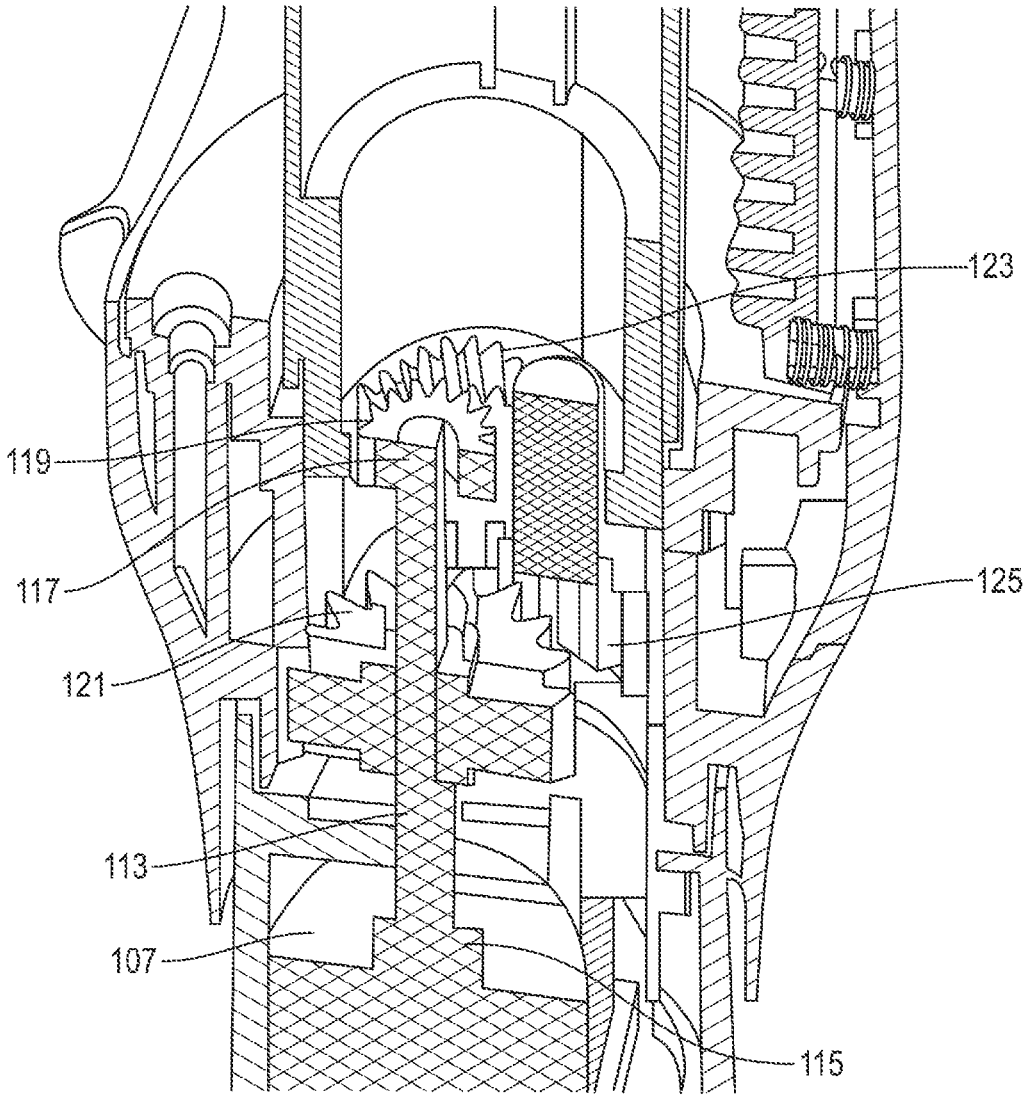
FIG. 1C is a detailed view of a barrel and the rotating mechanism, in accordance with features of an embodiment of the invention.

FIG. 1C is a detailed view of a gear assembly for both the barrel 102 and the collar. The drive motor 107 comprises a motor axis 113 with a proximal end 115 attached to the motor and a distal end 117 terminating in a barrel rotating gear 119. Intermediate the proximal end 115 and the distal end 117 is positioned a rotating member rotating gear 121, such that the barrel rotating gear 119 and rotating member rotating gear 121 are coaxially arranged with each other and generally positioned along the longitudinal axis of the device. The barrel rotating gear 119 may have a smaller diameter relative to the rotating member rotating gear 121 so as to confer a slower barrel rotation speed compared to the rotating member rotation speed. Alternatively, or in addition, the RPM is controlled by the gear ratio and the number of gear teeth on each of the barrel rotating gear 119 and the rotating member rotating gear 121.

The proximal end of the barrel 102 defines a first gear surface 123 adapted to mate with the barrel rotating gear. FIG. 1C depicts the gear surface residing along the periphery of a medially facing surface of the interior of the barrel. Similarly, a medially facing surface of the rotating member 106 defines a second gear surface 125 adapted to mate with the rotating member rotating gear 121.

The drive motor 107 is typically an electric motor (e.g., an AC or a DC electric motor). Electricity can be provided to the drive motor using a rotatable power cord 120 (e.g., a swivel power cord) communicating with the proximal end (i.e., heel end) of the handle.

As depicted in FIG. 2A, directional switches 114, 116 may cause the motor (and therefore the rotating member) to rotate in clockwise or counter-clockwise directions. For example, upon viewing FIG. 2A, the directional switch 114, when toggled by the user, may cause the rotating member 106 and or heated barrel 102 to rotate in that toggle direction, which in the drawing is upwardly. Conversely, directional switch 116, when toggled downwardly, may cause the rotating member 106 and or heated barrel to rotate downwardly. Upon release, the switches may bias to neutral such that no rotation occurs unless the switches are continually toggled by the user.

Figure 2B:
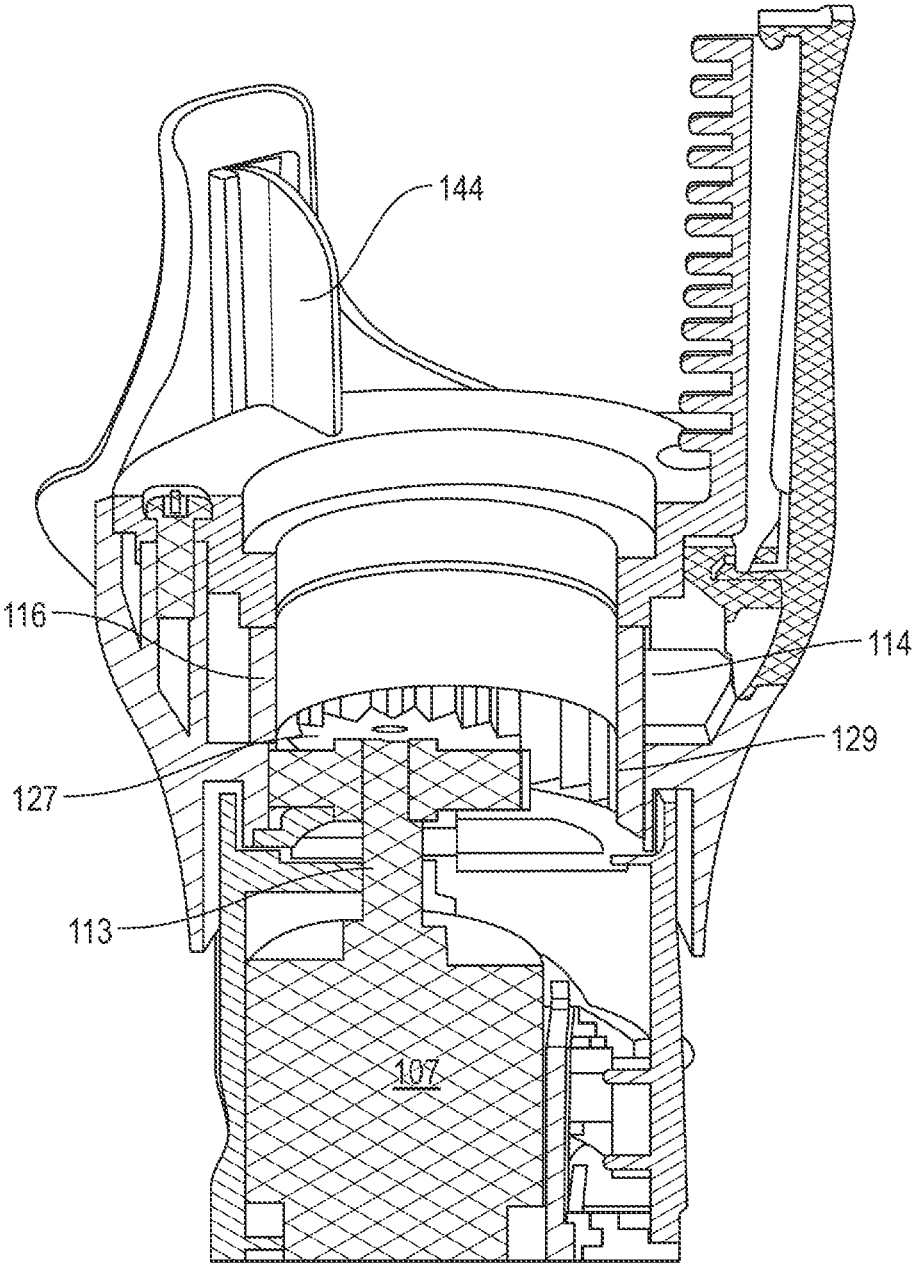
FIG. 2B is a detailed view of the direction dial actuation mechanism, in accordance with features of the present invention.

FIG. 2B is a detailed view of the gear mechanism associated with the directional switches 114, 116. As with the other gear mechanisms, the gears in this mechanism are actuated by the motor axis 113, which is rotated by the drive motor 107. As such, a single motor axis 113, and therefore a single motor, actuates all of the gears associated with this device.

Positioned inferior from the directional switch 114, 116 is the gear mechanism of switches and comprises a curl dial rotating gear 127 and an internal gear 129 of the curl dial. The rotating gear 127 comprises a radially extending plurality of teeth circularly arranged to form a disk. The internal gear 129 is configured to matingly receive the teeth such that the internal gear comprises a medially facing, cylindrical surface with a topography of gear teeth.

An electrical circuit (e.g., a printed circuit board) can be arranged within the handle or another component to distribute electrical signals from the various switches to the drive motor 107 and heating element 103.

While the handle 104 is illustrated as generally being a cylindrical member formed in line with the heated barrel 102, other configurations are possible. For example, in some embodiments, the handle can be a pistol grip-like handle that is arranged at an angle (e.g., substantially perpendicular) relative to the heated barrel.

The hairstyling apparatus 100 can include any of various drivetrain components (e.g., gear systems or transmission devices) to convert the rotation of the motor into the rotation of the rotating member 106, the barrel 102, or a combination thereof. The drive motor (including any drivetrain components) can be configured to rotate the rotating member 106 at any of the various suitable speeds. For example, the drive motor can cause the rotating member 106 to rotate at about 10 rpm to about 300 rpm (and within that range e.g., about 20 rpm to about 100 rpm, e.g., or about 50 rpm to about 100 rpm). Bearing elements can be disposed between the rotating member 106 and the barrel 102 or handle 104 to help reduce and limit rotational friction so that the rotating member 106 can rotate more easily relative to the barrel 102.

The rotating member 106 is typically configured to rotate relative to the barrel 102 (e.g., around the hairstyling surface) to receive (e.g., gather, grasp, retain, trap, grip, pick, or otherwise attach) hair and wrap the hair around the heated barrel 102 to be curled as it rotates. As illustrated in FIG. 4, the rotating member 106 includes a rotating plate 130 and a hair holding tab 110 that extends axially from the rotating plate 130 generally longitudinally along the hairstyling surface 132 of the heated barrel 102. As the rotating member 106 rotates around the barrel 102, the holding tab 110 catches the hair to bias it toward and otherwise guide it against and around the barrel 102 so that the hair spirals around the barrel rather than just twisting or tangling. The tab may or may not extend over the entire length of the hairstyling surface 132. In some embodiments, the tab 110 can have a length to extend from the rotating plate 130 along the hairstyling surface for about 0.1 inches to about 2 inches.

Comb Detail

As depicted in FIG. 3A, the combing feature further comprises a comb member 134 that is attached to the tab 110 and extends axially along a substantial length of the tab 110. In some embodiments, the comb member 134 can be reversibly attached to the tab 110, such as removably received by the tab so as to overlay distal portions of the tab, for easy application and removal by the user. For example, a longitudinally extending base surface of the comb may be adapted to slidably communicate with longitudinally extending surfaces of the tab, wherein the comb base defines a cavity with a cross section slightly larger than the cross section of the comb to engage in a friction fit. Other reversible attachment means may be a snap-fit configuration.

The tab 110 is radially displaced from the hairstyling surface so as to provide space for other parts, for example, the comb member 134. In some embodiments, the comb member 134 may extend substantially the full length of the tab 110. In some other embodiments, the comb member 134 may extend along a part of the tab 110, but shorter than the tab, for example, two-thirds of the full length of the tab 110.

As illustrated, the comb member 134 comprises a plurality of comb teeth 136 that are disposed along the length of the hairstyling surface and extending at an angle Ø to the longitudinal axis of the comb. The angle Ø is generally in a range between 10 and 170 degrees, for example, between 45 and 135 degrees, and also about 90 degrees. Generally, the teeth 136 can typically extend towards the hairstyling surface 132 while keeping spaced from the hairstyling surface 132 to provide adequate room for hair to fit between the comb member 134 and barrel 102.

Figure 3B:
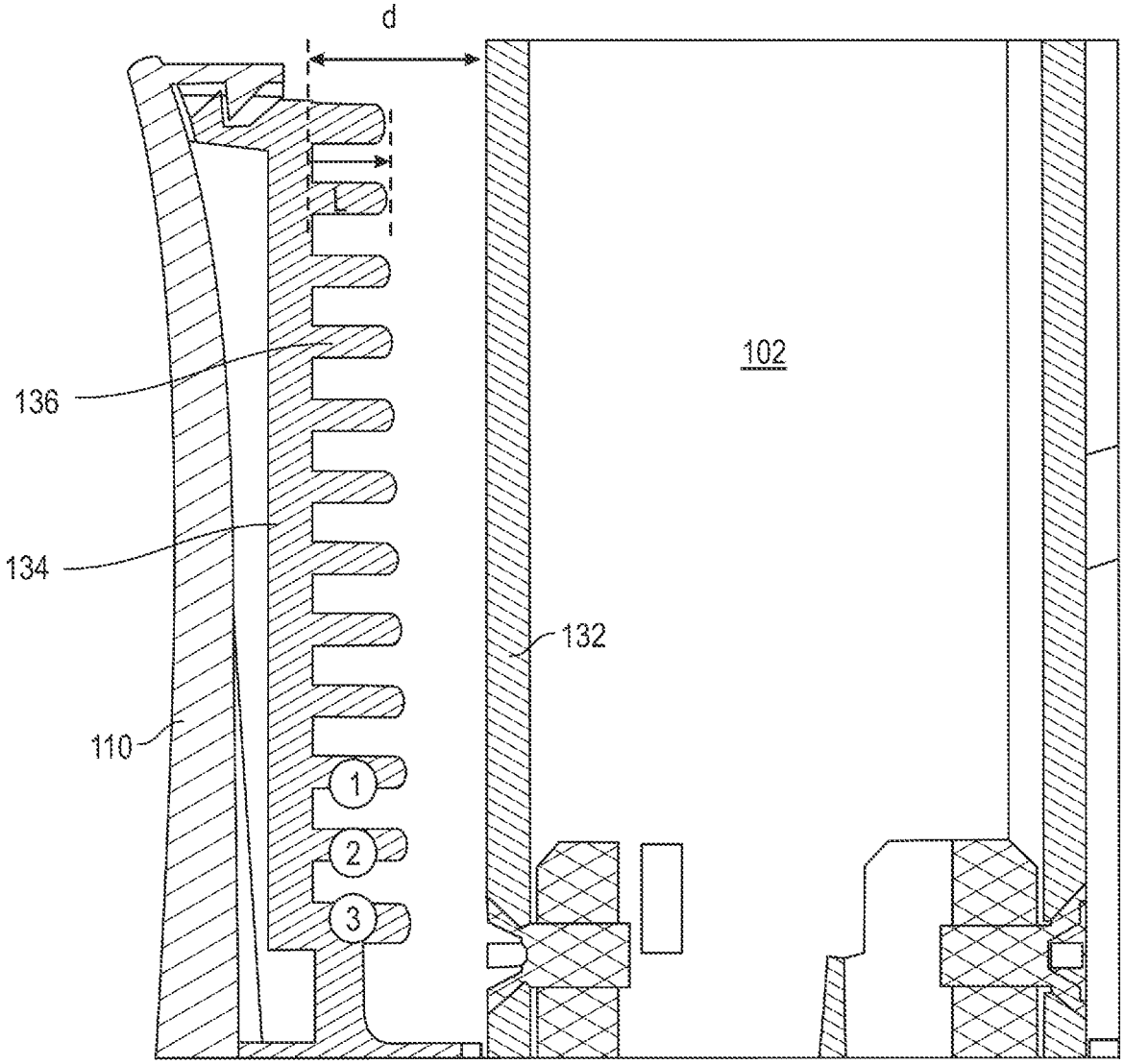
FIG. 3B depicts a comb positioning mechanism in accordance with features of the present invention.

The length of the comb's teeth may be different from each other. Referring to FIG. 3B, "d" defines a distance between the comb member and the hairstyling surface. "L" designates the length of the tooth. The range of the individual tooth length is defined as "0<L<d" such that during use, the hair resides in the gap between the distal end of each tooth and the hairstyling surface (i.e., d–L) while the hair is being wound onto the barrel. If the gap is larger, more hair goes into the gap easily. In this way, the user can save on hair styling time.

In some embodiments, the length of several comb teeth near the proximal end 140 of the comb member 134 (for example, tooth 1,2,3 in FIG. 3B) could be the same length to make an even hair winding.

The space between the comb member and barrel accommodates the hair for styling, depending on the tooth length of the comb. Different comb teeth lengths may be employed depending on hair thicknesses and lengths. For example, longer teeth may be used when thinner hair or smaller volumes of hair are to be worked. The inventors envision that when the ends of the hair only are to be curled, a longer tooth comb may be utilized by the user. Shorter teeth may be used when thick hair is to be manipulated.

The comb teeth 136 increase the friction force with the hair and thus may catch the hair easily. The comb teeth 136 also form some partitions along the length of the hairstyling surface and thus prevent the hair from moving along the length of the hairstyling surface. Therefore, the hair can be evenly disposed. The comb teeth 136 extending towards the hairstyling surface 132 also press the hair against the hairstyling surface 132. Thus, the heat can be effectively transferred from the hairstyling surface onto the hair.

The comb defines a first proximal end 140 and a second distal end 141. As illustrated, the lengths of the respective comb teeth 136 become gradually longer in a direction from the distal end 141 of the comb member 134 towards the proximal end 140 or bottom of the comb member 134. This makes the space between the comb member 134 and the hairstyling surface 132 greater at the distal end 141 than the proximal end 140. It facilitates the user to position a bundle of hair into that space from the end 141. It also facilitates the tab to catch the hair, press the hair against it, and wrap the hair around the hairstyling surface 132. In other embodiments, the comb teeth may have consistent lengths. In yet other embodiments, the comb teeth may have other forms of varying length. For example, the center teeth may be longer than the teeth at either end. In other examples, the tip of the teeth may form a profile such as a wave-like form.

In some embodiments, the comb teeth have varying lengths such that at least one tooth leaves a space between its tip and the styling surface while at least one other tooth contacts the styling surface. In this case, the comb teeth are made of a material with some degree of elasticity, such as, silicone, rubber, and plastics. The teeth, especially longer ones that contact the surface, will deform and thus exert a force pressing the hair against the hairstyling surface. In yet other embodiments, all the teeth may extend to be within a close spatial relationship with the styling surface (but not touching the surface) or even touch the styling surface to apply greater force to the hair against the styling surface.

As illustrated, the comb member 134 comprises a single row of comb teeth 136 arranged along the length of the hairstyling surface 132. In some embodiments, the comb member 134 may comprise more than one row of comb teeth. For example, the comb may have a plurality of rows of teeth, such as 2, 3 or 4 rows of teeth. The plurality of rows may be arranged to define a brush. In yet other embodiments, the comb member 134 may comprise a plurality of comb teeth that may not necessarily align with each other either in the length or the width of the tab. Further, the teeth may not align necessarily straight but define a curvature along the length of the comb. This allows the user to impart different shapes to the wound hair on the barrel. As such, different comb configurations defined by deviations along the longitudinal comb axis are part of the styling device.

Figure 3C:
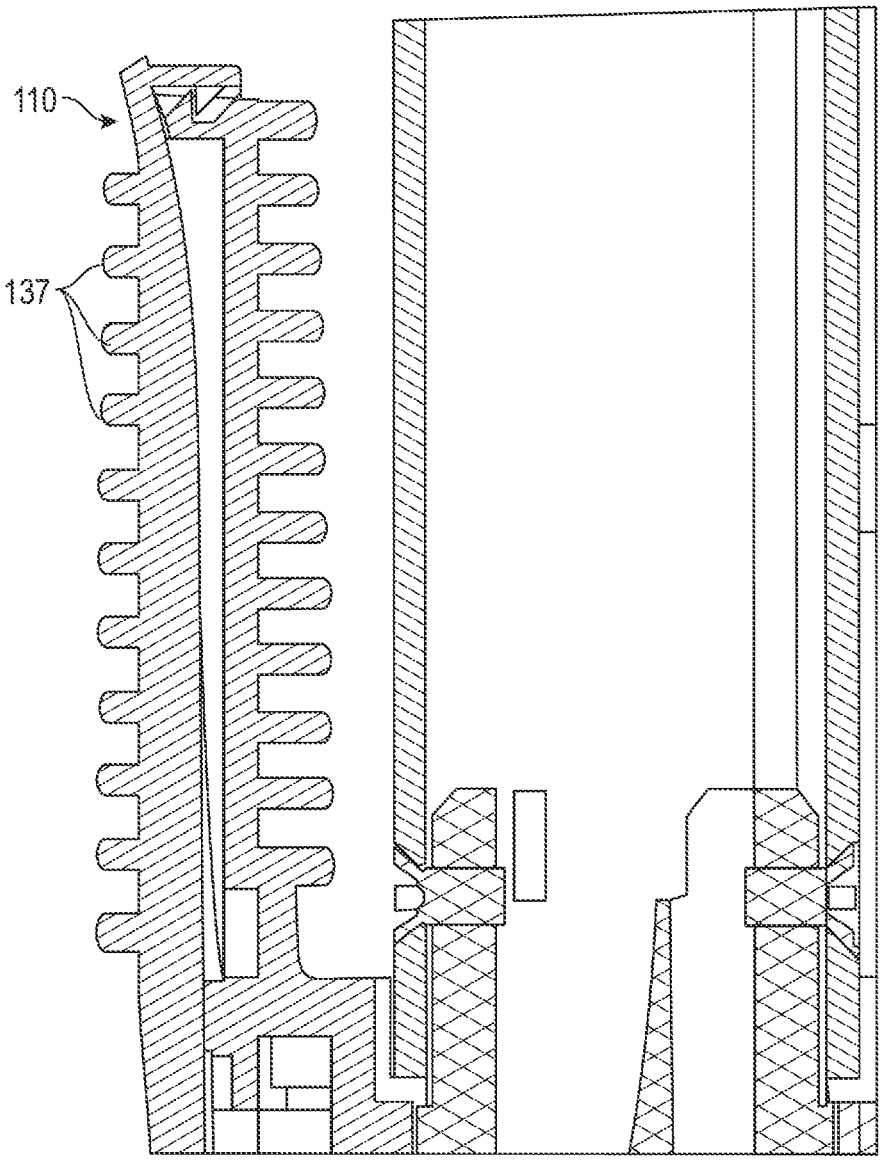
FIG. 3C depicts another comb positioning mechanism, in accordance with features of the present invention.

In some embodiments, the comb teeth can extend from the tab 110 not medially but rather in a direction away from the hairstyling surface 132. For example, as depicted in FIG. 3C, additional comb teeth overlying the tab may extend radially, and in a direction away from the hairstyling surface such that the tab is positioned between the originally medially extending teeth 136, and the additional comb teeth. In this example, the comb member 134 may still have the hair disposed more evenly along the length of the hairstyling surface 132.

Blade Detail

The invention facilitates styling small or large bundles of hair. At least one of the axially extending protruding members of the device may be the same length, longer, or shorter in length than the tab. These additional axially extending members may support a medially directed blade 144 (also having a similar appearance to a fin) adapted to catch, contact, or otherwise engage a small bundle of hair around the hairstyling surface and press the hair against the hairstyling surface.

FIG. 3A further depicts such a blade 144, medially directed toward, and therefore opposing a surface of the heated barrel 102. As described more fully, infra, the blade may extend the length of the heated barrel 102 and define a straight continuous distal edge. Alternatively, the fin may create a serpentine surface wherein longitudinally extending portions of the fin are convex while adjacent portions are concave. In instances where more than one serpentine blade is used, the blades are attached so as to be in registration with each other such that concave portions align along the radial arc of the curling surface. Similarly, the convex portion may also lie in registration with each other. This may help in imparting a wave, or waves to the hair.

Figure 3D:
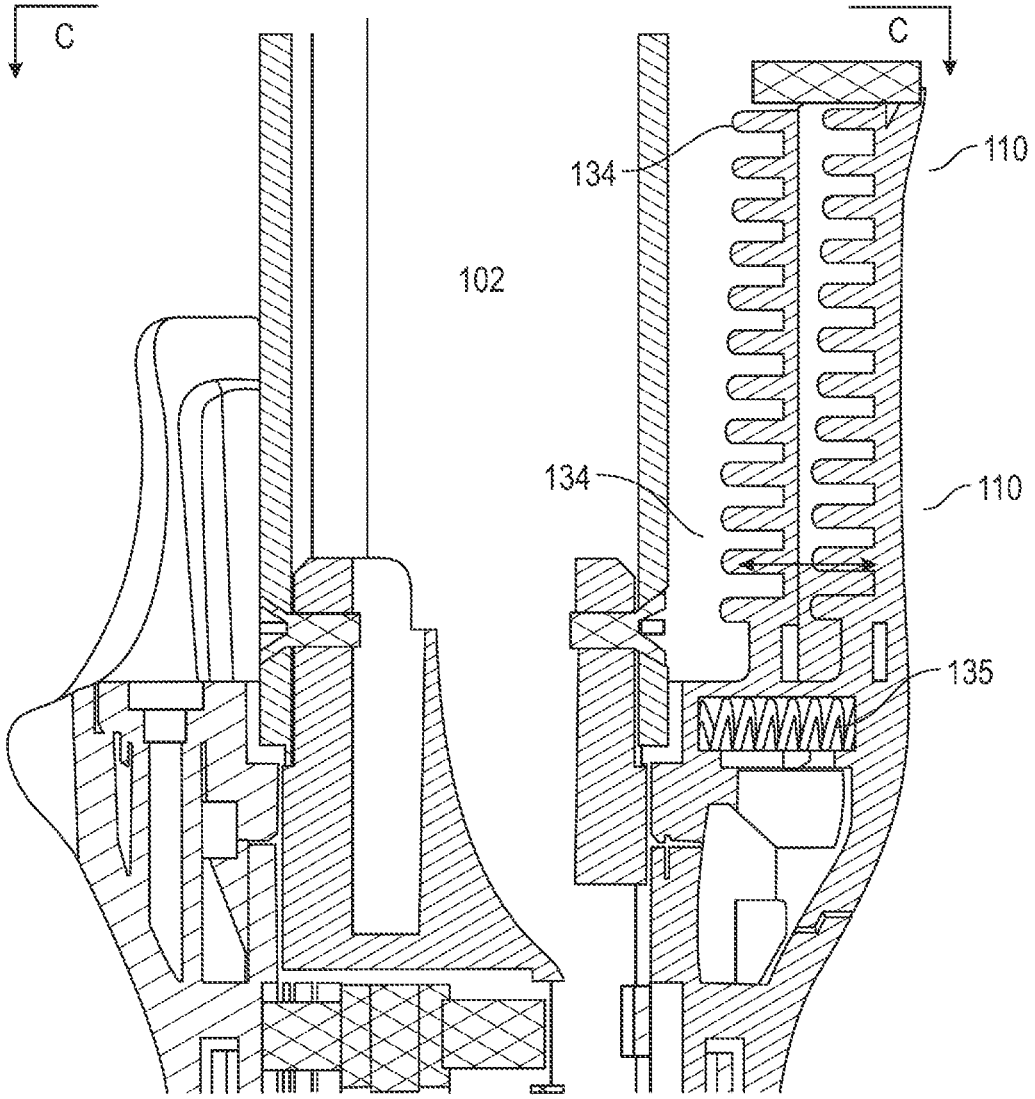
FIG. 3D depicts a mechanism for enabling the movement of a comb, in accordance with features of the present invention.

FIG. 3D shows a mechanism for enabling the comb member 134 to slide toward (i.e. medially) or away (radially) from the heated barrel 102. (This view and the one in FIG. 3E has the device rotated 180 degrees about its longitudinal axis relative to the views of FIGS. 3A-C.) In one embodiment, just the comb would move relative to the tab 110. In this configuration, a spring 135 or a plurality of springs are positioned between the comb and the tab. As more hair is gathered between the comb and the heated barrel 102, the springs 135 are compressed to make way for more hair. Upon exiting the space between the distal tips of the comb and the barrel 102 surface, the spring(s) decompresses, causing the comb to advance toward the barrel 102 surface. In another embodiment, both the comb and the tab would move.

The comb depicted in FIG. 3D is spring biased toward the heated barrel via the spring 135. Generally, the spring is disposed in a direction orthogonal to the longitudinal axis of the comb. The spring 135 is shown proximal to the base of the comb with a first end biased in a radial direction and contacting the base of the comb. A second end of the spring is therefore biased in a medial direction and contacts a surface that is immobile, relative to the base of the comb.

Furthermore, the comb member 134 is not physically attached to the rotating plate 130, such that only the comb moves radially or medially.

Figure 3E:
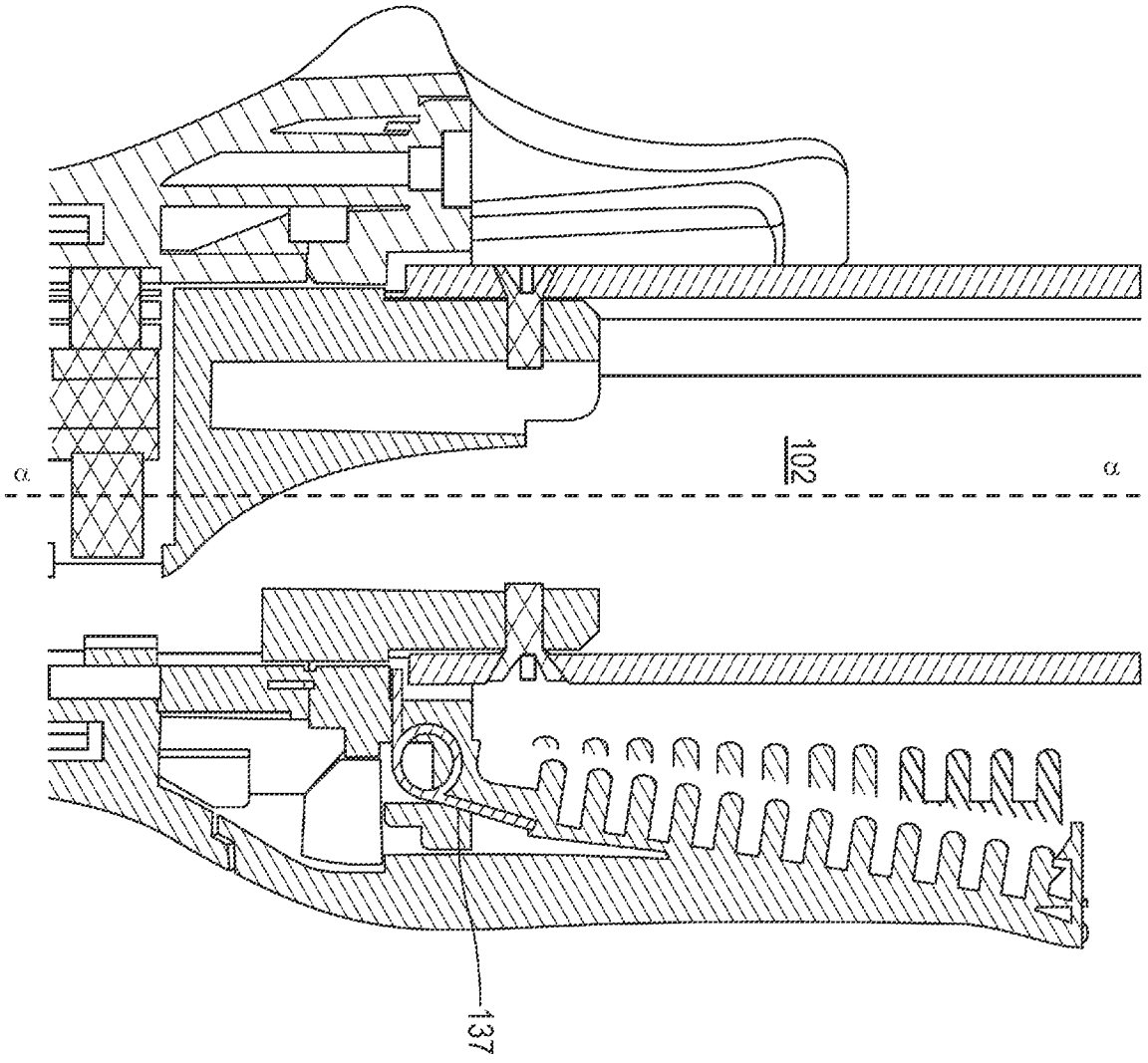
FIG. 3E depicts a comb featuring its proximal end in hinged communication with the rotating member proximal to the base of the barrel.

FIG. 3E depicts a comb featuring its proximal end in hinged communication with the rotating member proximal to the base of the barrel. A torsion spring 137 is depicted and adapted to bias the comb to a position that is generally parallel with the longitudinal axis $\alpha$ of the barrel. As such, and as with the wire spring 135 depicted in FIG. 3D, the torsion spring 137 is positioned proximal to the base of the heated barrel. A first end of the spring is embedded or otherwise attached to the base or proximal end of the comb member 134, while a second end of the spring is attached to a stationary structural support circumscribing the proximal end of the barrel 102.

One torsion spring is positioned at the bottom part of comb. When a large bundle of hair is wound on the barrel, the comb is leaned with an angle to the inside of the tab and holds the large bundle of hair. When a user finishes hair styling, the comb moves to the original position by the restoration force of the torsion spring, this feature provides a means for eliminating the need for the user to pull back the comb with her free hand. Rather, hair styling can commence in a normal way with a bundle of hair pushing or otherwise moving the comb. The comb is attached to the tab in another embodiment, and the combination leans an angle.

As illustrated in FIG. 4, the rotating member 106 further comprises two protruding members 142 extending from the rotating plate 130 and along the longitudinal axis $\alpha$ of the hairstyling surface 132. Each of the protruding members 142 may support the aforementioned blade 144, extending medially along the length of the hairstyling surface 132 so that their tips oppose the hairstyling surface 132. (The protruding members 142 may also help to catch hair and direct and guide it against and around the barrel 102 so that the hair spirals around the barrel rather than just twisting or tangling.) The blade 144 further presses the hair against and around the barrel 102. The blade 144 is made of a reversibly deformable (i.e., non-rigid or semi-rigid) material with some degree of heat resistance and flexibility, such as silicone, rubber, or plastic. The blade 144 therefore allows a range of hair amounts to spiral around the barrel. For example, the blade 144 may simply flex more when there is more hair between the protruding members 142 and the hairstyling surface 132. This flexibility allows the blade 144 to press the hair with elastic force against the hairstyling surface 132. The heat can be more efficiently transferred onto the hair from the hairstyling surface 132. In some cases, the blade 144 with elasticity may even protrude to contact with the hairstyling surface 132 so that to press more firmly hair against the hairstyling surface 132. In some embodiments, the rotating member 106 may comprise one protruding member or more than two protruding members. (The protruding members 142 are extended from the rotating member 106) In some embodiments, at least one of the protruding members do not support a blade. In other embodiments, a blade 144 may be combined with a comb member 134.

As illustrated, the protruding members 142 is typically shorter than the tab 110. The protruding members 142 with shorter length is more efficient in catching a smaller bundle of hair. In some embodiments, the protruding members 142 may have a length that is from one-third to two-thirds of the length of the tab 110. In some other embodiments, the protruding members 142 has a length that is substantially the same as or even longer than the length of the tab 110.

The protruding members 142 and the tab 110 are arranged evenly along a circumferential direction of the hairstyling surface 132. When two protruding members 142 are provided, the two protruding members 142 are spaced from each other for an angle of between about 10 degrees to 270 degrees, and within that range, for example, from 30 degrees and 180 degrees, for example, about 120 degrees. Each of the protruding members 142 is spaced from the tab 110 for an angle of 120 degrees. Therefore, the two protruding members 142 and tab 110 are spaced from each other and will not interfere with each other. In some other embodiments, the protruding members and the tab can be arranged unevenly.

As described supra, the rotating member 106 comprises one or more hair retaining elements disposed around a peripheral region of a rotating plate. The retaining elements catch the hair when the rotating member rotates around the hair, further enabling the user to use the device with one hand.

The retaining elements may protrude from the rotating member 106. The hair retaining elements are configured to receive a user's hair so that the hair can be wrapped around the styling surface for curling. However, the rotating member may further comprise radially extending ridges 146 (FIG. 3A) that protrude from the rotating plate away from the hairstyling surface and extend along the longitudinal length of the hairstyling surface. As illustrated, the rotating member 106 includes one or more hair retaining elements, such as radially extending ridges 146, configured to receive a user's hair (e.g., one or more hairs) so that the hair can be wrapped around the styling surface of the heated barrel 102 for curling. As such, the ridges are hair retaining elements.

FIGS. 3A-3E and FIG. 4 depict six ridges as the radially extending ridges 146 distributed circumferentially around the perimeter region of the rotating member 106, but fewer or more ridges may be employed. The radially extending ridges 146 are shown integrally molded with the rotating member 106 but alternatively may be removably attached to same. The radially extending ridges 146 extend along the length of the rotating member 1-6 surface and radially protrude from the exterior peripherally extending surface of the rotating member 106. The ridges may come in pairs in which case a space may be disposed between adjacent ridges comprising a pair. This first space is smaller in arc distance than the space between pairs of ridges.

In an embodiment of the invention, the ridges exist in pairs to provide a means for catching hair in both directions (e.g., clockwise and counter-clockwise). When the rotating dial rotates in a clockwise direction, the hair is caught by a first ridge (R1) in the square-designated area. The other direction is vice versa, such that the hair is caught in the oval-designated area. The first space is smaller or larger in arc distance than the space between pairs of ridges. It should be noted that more than one ridge is not necessary if a single ridge has a proper size and enough area in both sides of it to catch the hair in both directions.

The radially extending ridges 146 enable the user to retain and wrap hair around the barrel 102 in a more uniform, even distribution. For example, the user may lightly grasp the handle 104 of the device, but with distal portions of hair lightly held between the handle and the user's hand. Prior to curling, the user positions proximal portions of the hair between the ridges.

As illustrated, every set of two of the radially extending ridges 146 are arranged between adjacent protruding members 142 and between the protruding member 142 and the tab 110. Therefore, three sets two of radially extending ridges 146 are distributed substantially evenly around the rotating member. The spacing of adjacent radially extending ridges 146 create recess-like regions in which hair can lie and be retained. In some other embodiments, the radially extending ridges 146 can be simply arranged evenly around the rotating member.

Retaining elements formed along the rotating member can include any of the various types of features capable of catching or gather one or more strands of hair. For example, the retaining elements can include one or more hooks, recesses (e.g., semi-circular holes or other depressions), protrusions (e.g., knobs, pins, bristles, bosses), or any suitable combinations or these of other suitable elements.

The rotating member 106 together with the radially extending ridges 146 are typically longitudinally spaced away from the hairstyling surface of the barrel and more proximal to the handle 104 and, therefore, at the proximal end 109 of the barrel 102. That is, the hairstyling surface can be positioned at the free, exposed end of the hairstyling device relative to the rotating member 106. Such a configuration can enable the user to place the free end of the curling device towards their head so that the rotating member can gather the user's hair and wrap the free end of the hair around the heated barrel 102. This causes the hair to be gathered using the rotating member and wound around the proximal end of the hairstyling surface and, therefore, at the end opposite the free or distal end of the hairstyling surface.

As aforementioned, the hairstyling apparatus 100 also includes directional switches 114 and 116 (e.g., toggle switches) that can be used to change the rotational direction of the rotating member 106 so that the user can create differently shaped curls.

Figure 5:
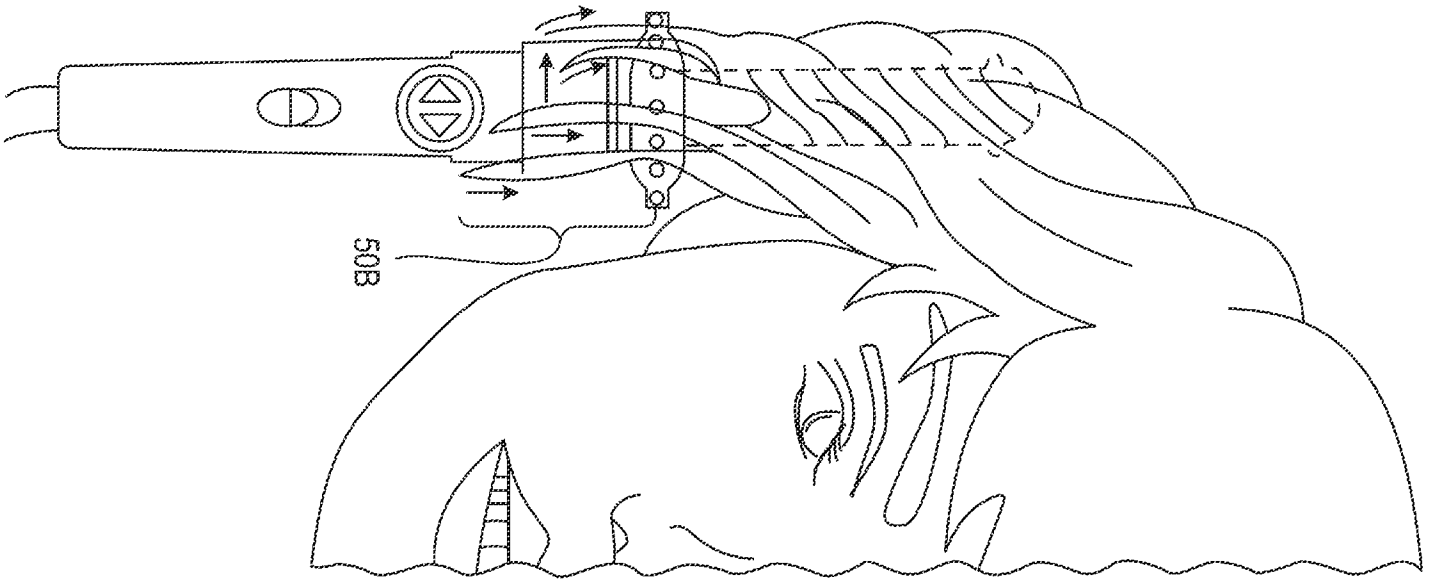
FIG. 5 depicts the invented device juxtaposed with a user's head.
Figure 6:
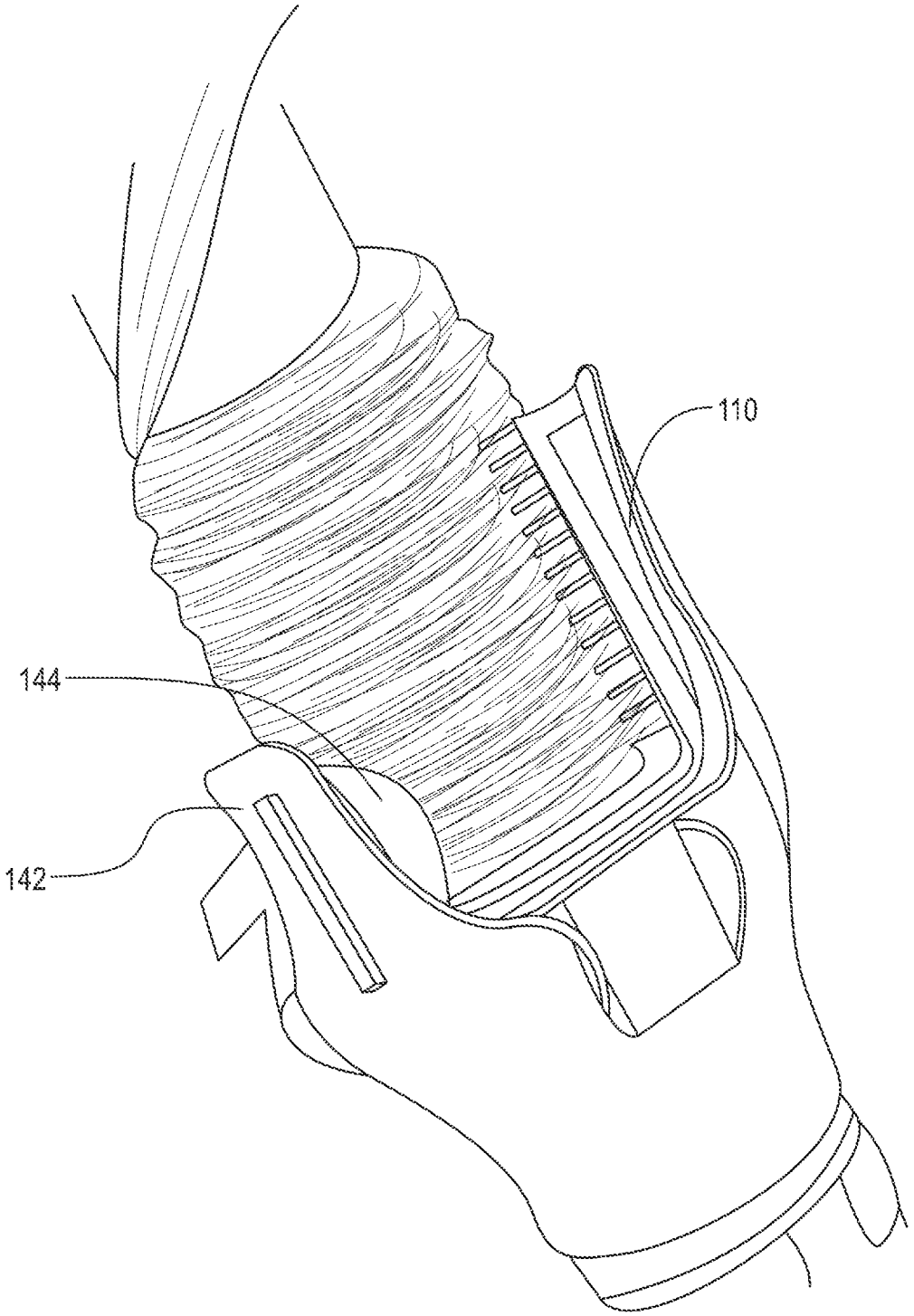
FIG. 6 is a close-up view of hair entrained within the invented device, in accordance with features of the present invention.

FIGS. 5 and 6 schematically depict hair curling steps when a user is using one of the hairstyling apparatuses described herein (e.g., the hairstyling apparatus 100). In some examples, the user may position the hairstyling apparatus against their hair with the cooling tip 122 directed towards their head. As depicted in FIG. 5, hair can fall and lie along the rotating member area 50B. As mentioned above, the retaining elements are typically distributed apart from one another to comb through the hair to limit or prevent tangling. The user may then cause head hair to be placed at the rotating member either by the action of gravity or manually, or by causing the rotating member to rotate. By keep rotating the rotating member around the hairstyling surface, the tab will catch the hair so as to wind the hair around the hairstyling surface. As the hair is wrapped around the hairstyling surface, free end regions of the hair are drawn through one or more regions of the rotating member and onto the styling surface.

After a period of time has passed and the hair is heated, the user can remove the hair curling device from their hair. As discussed above, since the hair is not directly grasped, pinched, or held by the rotating member or the barrel (e.g., as would be the case for a curling iron with a clamp), the user can typically just pull the hair curling device away from their head. While pulling the hair curling device away, the user may also press the directional switches 114 and 116 to facilitate the pulling and/or creating different curl shapes. When pulled away, the hair can typically become loosened from the barrel and slide through the retaining elements.

Referring to FIG. 6, as the hair is wrapped around the hairstyling surface, the comb teeth 136 distribute the hair along the length of the hairstyling surface. The teeth also prevent the hair from moving along the length of the hairstyling surface, therefore, prevent the hair from tangling. The comb teeth 136 typically extend towards the hairstyling surface 132, thus also press the hair against the hairstyling surface. Referring to FIG. 6, as the hair is wrapped around the hairstyling surface, the blade 144 presses the hair against the hairstyling surface 132.

A user can position a free end of a hairstyling surface (e.g., defined by a heated barrel) of a hairstyling device, such as the hairstyling apparatus 100 suitable for curling of hair, discussed above, in proximity to (e.g., at or near) the user's head. In some embodiments, the hair curling device (i.e., a longitudinal axis of the hairstyling surface) can be positioned substantially vertically next to the user's head. As illustrated, hair can be retained (e.g., gathered) within a rotating member of the hairstyling device. For example, hair can be gathered by radially extending ridges 146 of the rotating member, which act as hair retaining elements. As shown, the hair can be retained at the end of the hairstyling surface that is opposite the free end of the styling device.

In some cases, as the rotating member rotates, additional hair can be gathered and retained automatically by the retaining elements of the rotating member. Through the aid of the tab and the protruding members, the hair is wrapped around and pressed against the heated hairstyling surface. As the rotating member rotates, the tab and the protruding members extending from the rotating member can be used to press some or all of the hair against the hairstyling surface at the bottom end of the styling surface opposite the free end.

As the hair is wrapped around the hairstyling surface, free end regions of the hair can be drawn through one or more regions (e.g., retaining elements) of the rotating member and onto the hairstyling surface.

In some embodiments, the rotating member can continuously rotate about the barrel after the hair has been fully wrapped. In some cases, the rotating member can continue to rotate until the user releases the directional button (or presses a stop button) on the handle.

After a period of time has passed and the hair is heated, the user can remove the hair curling device from their hair. As discussed above, since the hair is not directly grasped, pinched, or held by the rotating member or the barrel (e.g., as would be the case for a curling iron with a clamp) or enclosed by a hair capturing housing or enclosure, the user can typically just pull the hair curling device away from their head. When pulled away, the hair can typically become loosened from the barrel and slide through the retaining elements.

Wrapping the user's hair around the barrel 102 in this manner, including winding the hair around the relatively stationary (i.e., non-rotating) barrel 102 using the rotating member 106 and pressing the hair against the barrel 102 using the tab and/or the protruding members can result in fewer snags, tangles, or pulled hairs during use. This enhanced performance is, at least in part, a result of the hair being pulled loosely by the retaining elements 108 and the holding tab 110, neither of which tightly clamp onto the hair.

In other words, when the rotating member 106 rotates to grip and rotate (e.g., twist, curl, wrap, spiral, or otherwise displace) hair (rather than clamping hair to the barrel and rotating it), the hair is guided around the barrel 102 and as it is formed into a spiral-like curl, it is tightened to the stationary barrel rather than a moving part, which could cause the hair to be pulled causing discomfort. Therefore, the rotating members described herein can typically reduce (or in some embodiments eliminate) the need for additional protection components such as clutches or sensor systems and make it easy for the users to create curled hairstyles.

Rotating Member Detail

Figure 7A:
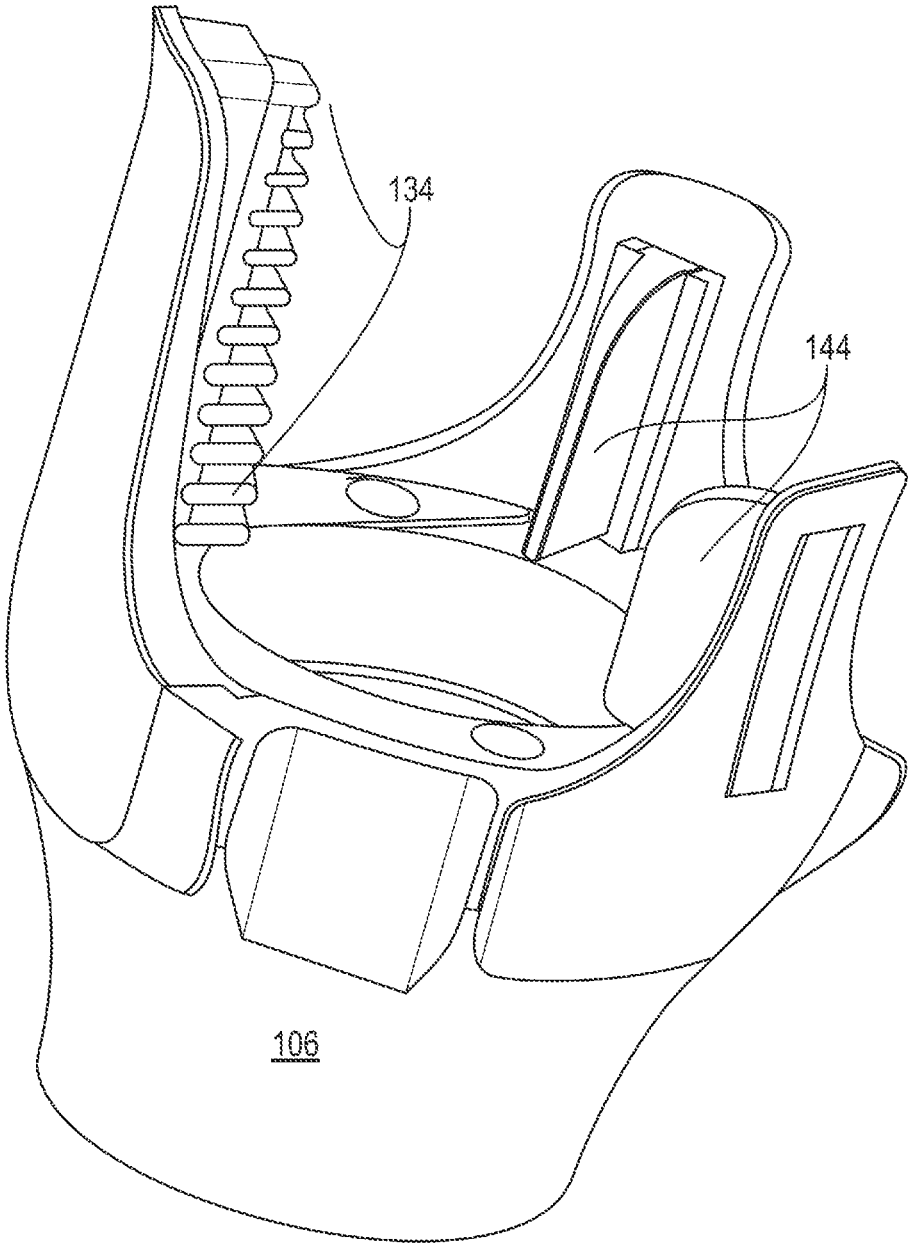
FIG. 7A shows a fully assembled collar, in accordance with features of the present invention.

FIGS. 7A through 7E show various views of the rotating member 106. FIG. 7A shows the rotating member 106 in assembly with the holding tab 110, the comb member 134, the blade 144, and the other axially extending protruding members 142.

Figure 7B:
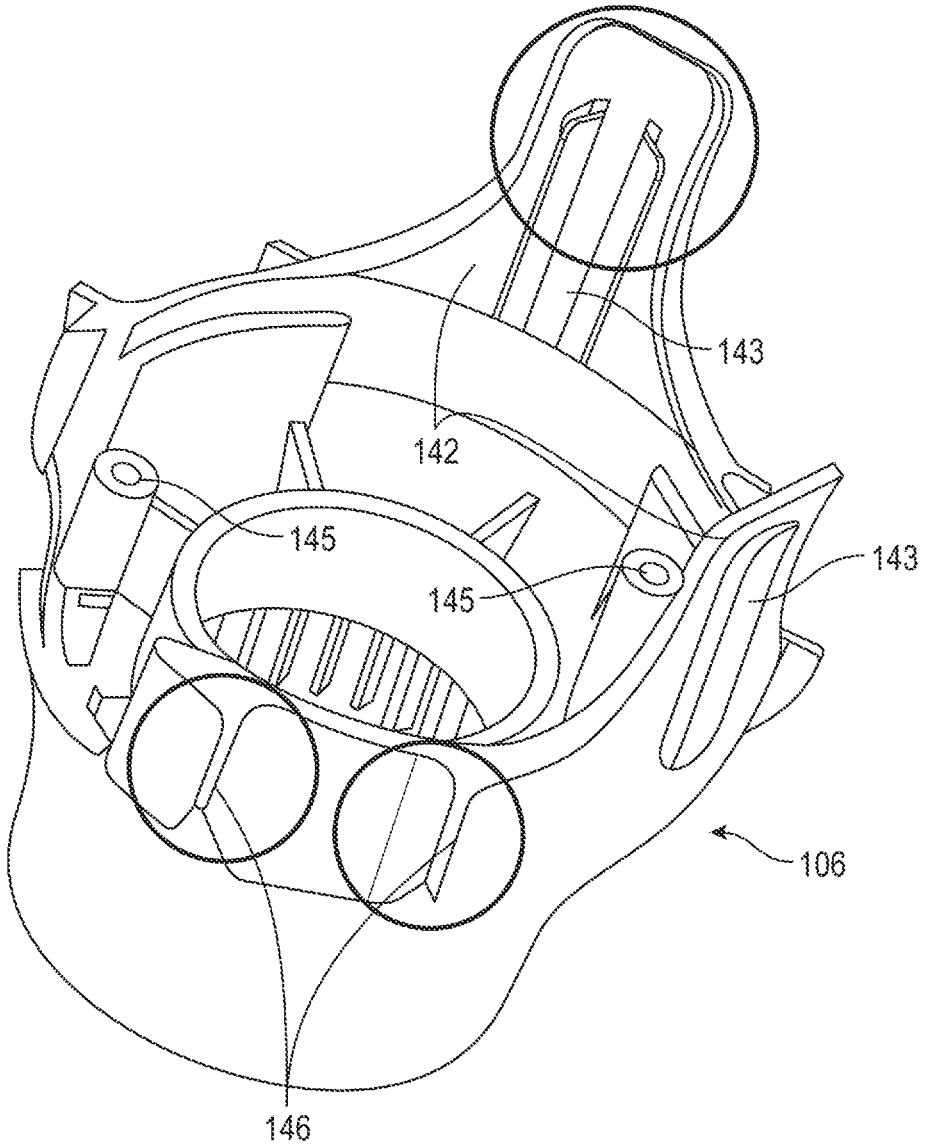
FIG. 7B is an isometric view of a collar for use with the invented device.

FIG. 7B depicts the rotating member 106 only. This figure shows apertures 143 formed in longitudinally extending regions of the axially extending protruding members 142. These apertures 143 are each adapted to removably receive a blade 144. The aforementioned ridges 146 are also shown, and integrally molded with an externally circumscribing periphery of the rotating member 106.

Figure 7C:
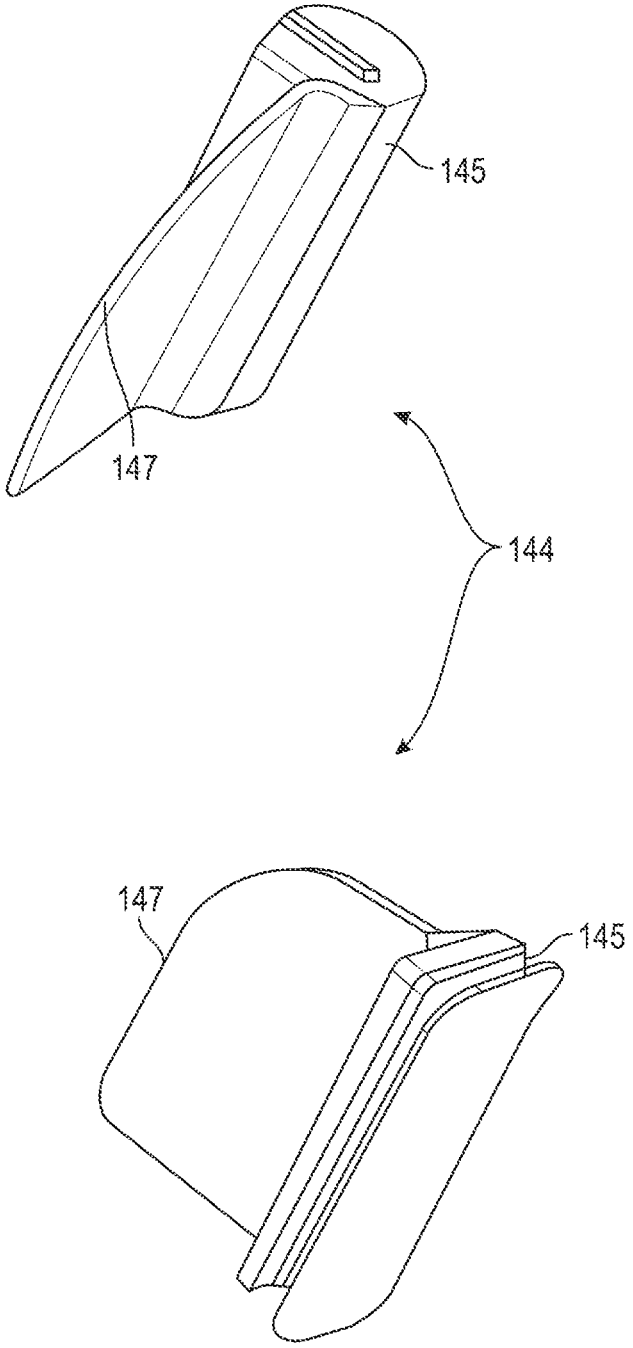
FIG. 7C are isometric views of fins for use in conjunction with the collar depicted in FIG. 7B.

Separate blades 144 are depicted in FIG. 7C. Viewed with FIG. 7A, proximal regions 145 of the fins define a reversibly deformable periphery having a cross section identical to the cross section of the apertures 143. The reversibly deformable periphery further defines a circumferentially extending groove adapted to be reversibly received by medially directed edges of the apertures 143. This allows for a snap fit relationship between the apertures 143 and the blades 144.

The blades 144 further define a distal portion 147 which provides medially directed contact points with the styling surface and therefore the hair disposed therebetween. The distal portion is wide enough to impose pressure on the hair, but not so narrow as to cut or otherwise damage the hair.

Figure 7D:
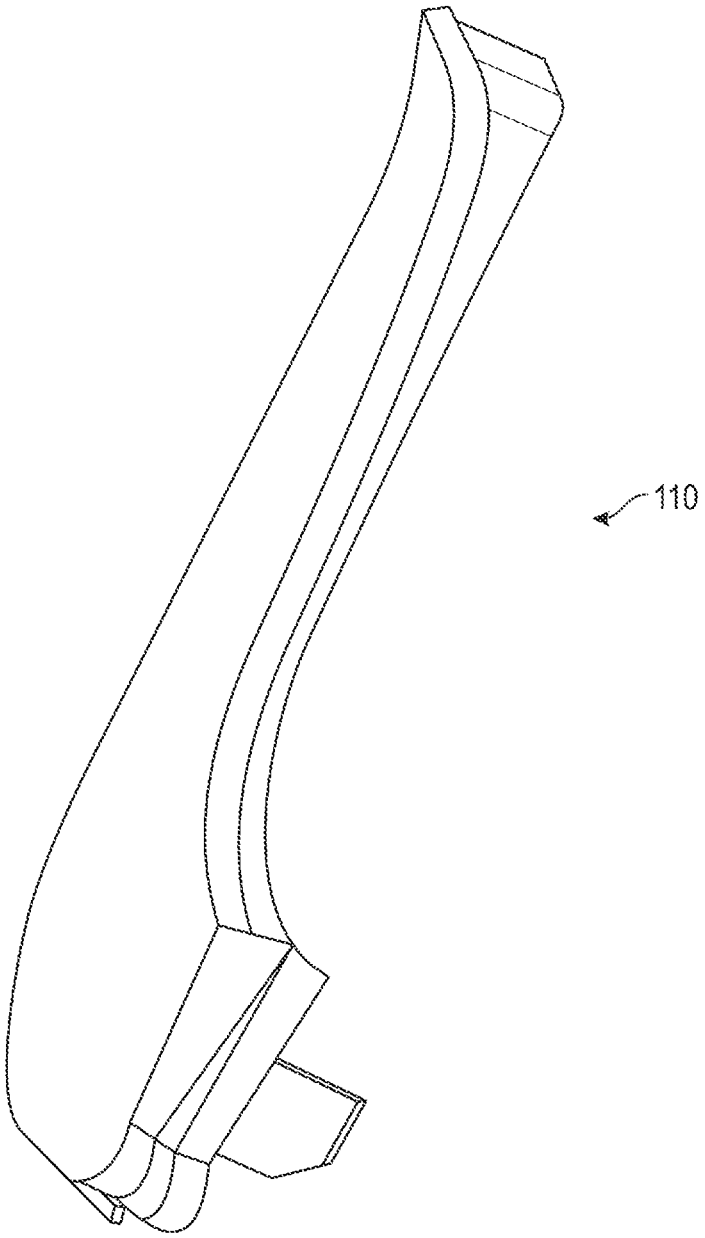
FIG. 7D is an isometric view of a tab for anchoring a comb for use with the invented device.
Figure 7E:
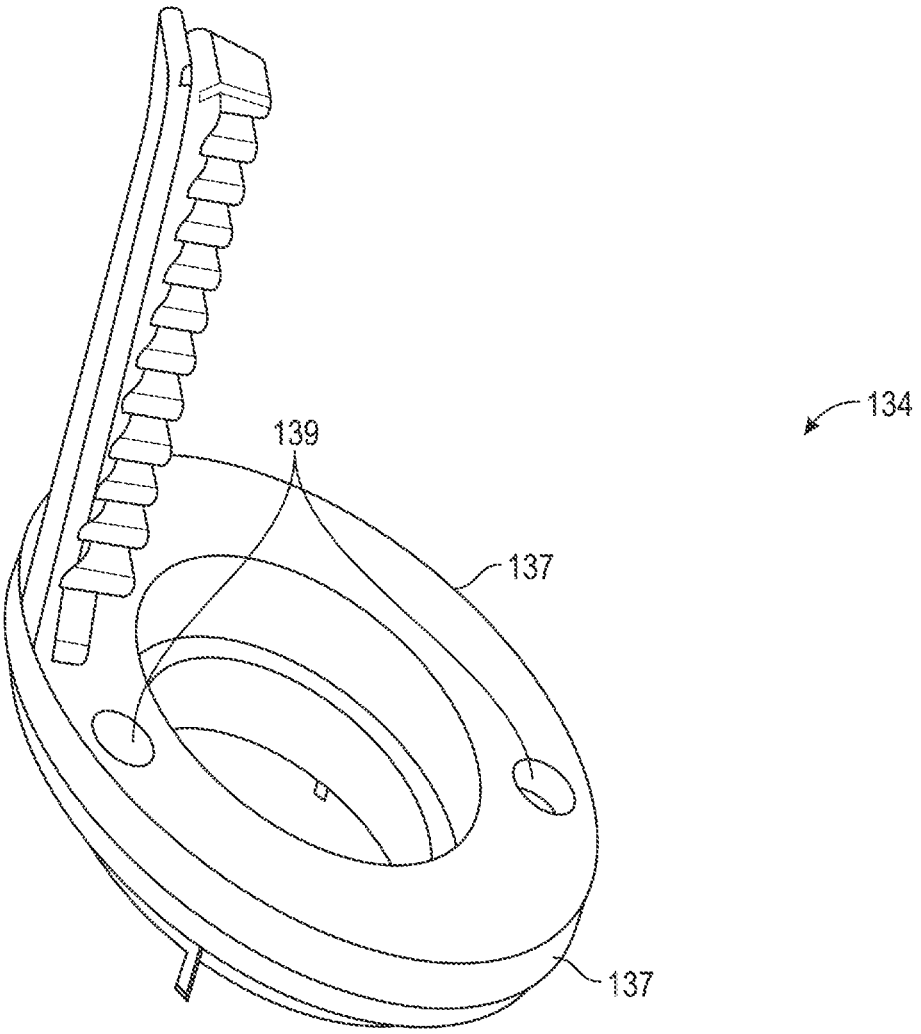
FIG. 7E is an isometric view of a comb for use with the invented device.

FIGS. 7D and 7E show the tab 110 and the comb member 134, respectively. Viewed in conjunction with FIG. 7A, the comb member 134 overlays the tab 110, which in turn snap fits into an upwardly directed periphery formed by the rotating member 106.

FIG. 7E shows that the comb member and the rotating plate are integrally molded as one body. It is assembled with the tab by sliding the comb part to the tab. The assembled part, [(tab+(comb & rotating plate)], is fastened to the rotating member by three bolts through the apertures 139 in the rotating plate. In one embodiment, the comb and the rotating member are separately molded as two parts. In this embodiment, the comb is assembled to the tab with two springs. This two-spring arrangement provides a means by which the comb can be moved into the hollow of the tab in a linear distance by a bundle of hair.

In another embodiment, related to FIG. 3E, the comb can be installed in a leaning configuration, with an angle and the top part of the comb goes into the hollow of the tab. Here, the comb is separated from the rotating plate and assembled to the tab with a torsion spring and a hinge.

Viewed in conjunction with FIG. 7B, portions of the rotating member defining axially extending apertures 145 lie in registration with the transversely extending apertures 139 to facilitate the fastening of the comb to the collar. The axially extending apertures may be threaded to accept threaded bolts or screws first slidably received by the transversely extending apertures 139.

Alternative Embodiment

Figure 8:
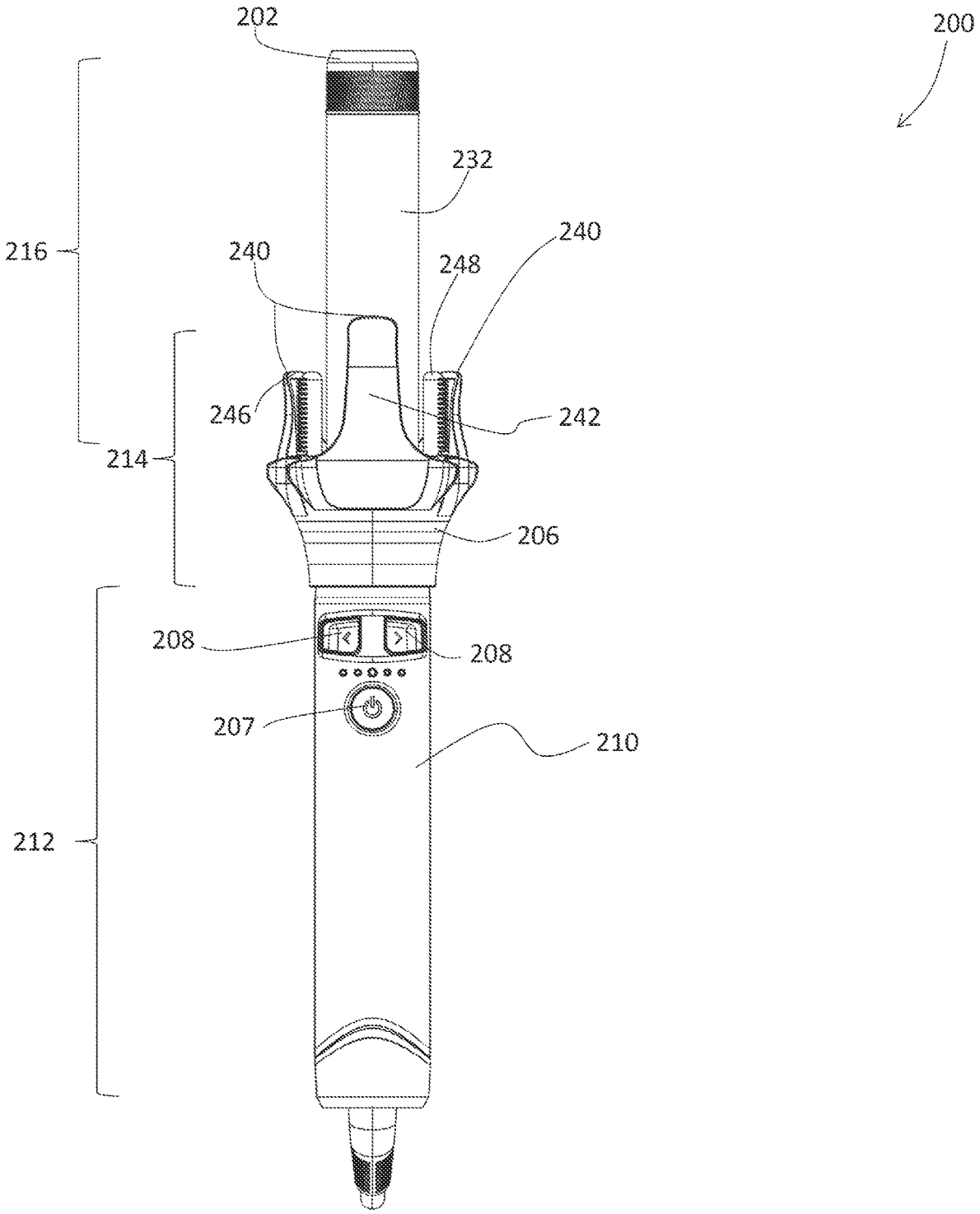
FIG. 8 is a side view of an alternative embodiment of the apparatus.

A side view of an alternative embodiment 200 of a hairstyling apparatus is depicted in FIG. 8. The alternative embodiment 200 includes a main body 210 comprising a handle portion 212, a hair manipulation portion 214, and a heated portion 216. As can be appreciated from FIG. 8, some of the portions overlap with each other. For instance, some elements of the hair manipulation portion 214 extend over the heated portion 216. As the alternative embodiment 200 is described, it will be apparent that elements of the hair manipulation portion 214 also heat hair, in addition to the heating portion 216 providing the majority of the heat energy.

In the alternate embodiment 200, a rotating member 206 includes multiple hair-holding tabs 240. Each hair holding tab 240 extends axially from the rotating member 206 and generally longitudinally around the hairstyling surface 232 of the heated barrel 202. As can be appreciated from FIG. 9, each hair holding tab 240 can be of a different size. For example, in the embodiment 200 shown in FIG. 9, one tab 240 is larger than the remaining two tabs.

The main body 210 includes movement buttons 208, which rotate the rotating member 206 in the direction indicated on the movement buttons 208. The main body 210 also includes at least one power button 207 and heating indicators in one embodiment.

Figure 9:
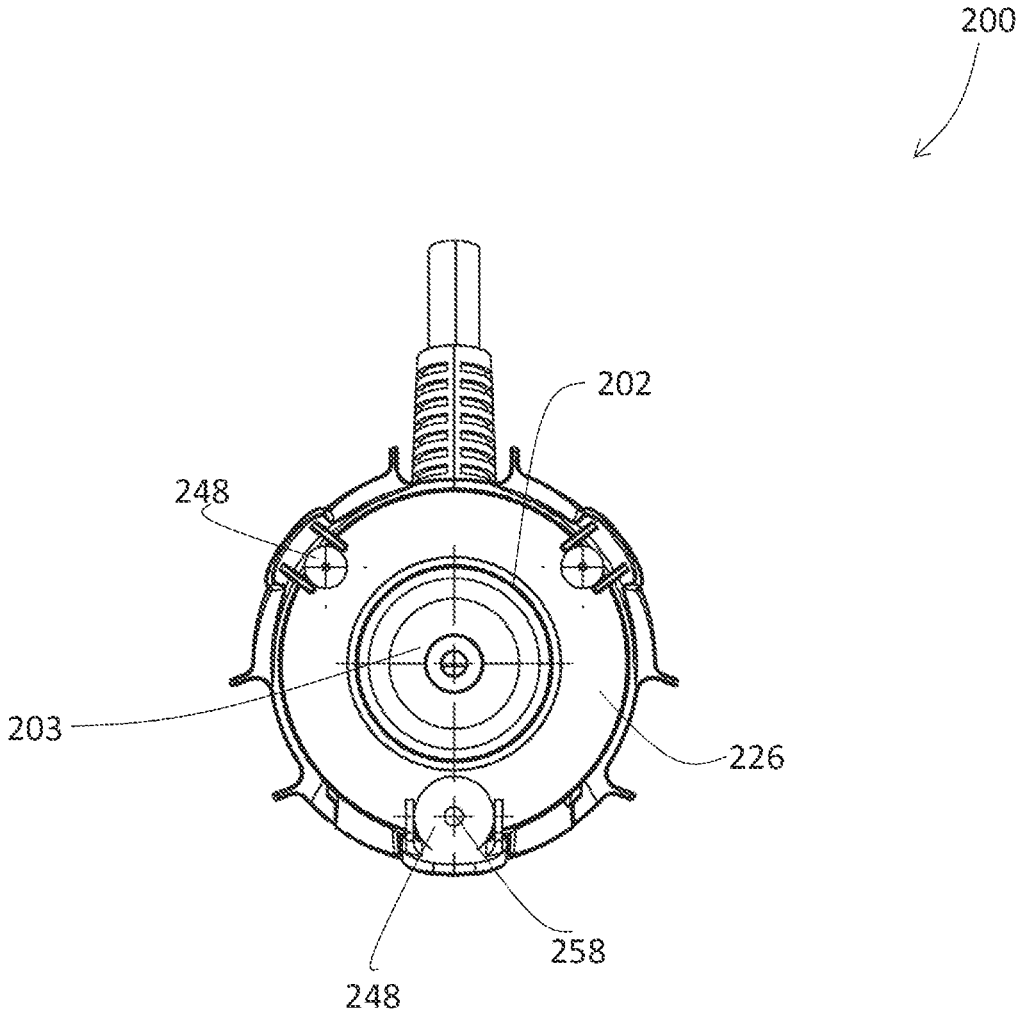
FIG. 9 is a top view of the alternative embodiment.

While the embodiment shown in FIG. 9 shows three tabs 240, other quantities of tabs are used in other embodiments. A benefit of the three-tab configuration of FIG. 9 is that sufficient space remains between the components of the hair manipulation portion 214 to prevent the tangling of hair.

Each hair holding tab 240 is fixed in place, in one embodiment, and is constantly fixed with a fixed distance away from the hairstyling surface 232 of the heated barrel 202.

Each hair holding tab includes an external surface 242 and an internal surface 246. The internal surface 246 of each tab includes peripheral walls and a central indentation. In this way, the internal surface 246 comprises a holder for at least one rod 248 and a comb 250 on either side of the rod 248.

Each rod 248 is in communication with the base plate. The base plate, in turn, transfers heat from the heated barrel 202. As each rod 248 comprises a heat transferring material, such as metal, each rod 248 will likewise be heated as the heated barrel 202 heats up.

In one embodiment, each rod 248 is fixed to the base plate and its corresponding comb 250. In another embodiment, at least one rod 248 rotates around an axis (shown in subsequent figures). The combination of the rod 248 and the comb 250 is adapted to arrange and organize hair passing through the device during styling.

A benefit of this embodiment 200 is that the rods 248 are in contact with the same heat source as the heated barrel 202, and so the rods 248 do not require individual heating elements.

The rods 248 comprise a heat-transferring metal in one embodiment. The rods 248 comprise iron, aluminum, copper, and the like. In one embodiment, different rods 248 have different compositions, which results in each rod having a different temperature during the use of the embodiment 200.

The rods 248 are attached to the internal surface 246 of the tabs by passing over a pin extending from the base plate in one embodiment. In another embodiment, the rods 248 are attached by snapping into the opening defined by the combs 250.

As can be appreciated from the drawings, the rods 248 heat up along with the hairstyling surface 232 of the heated barrel 202. Therefore, hair passing between the rods 248 and the hairstyling surface 232 will be heated from both sides. The combination of the rods 248 and combs 250 ensures that the hair passes through the device without being tangled up but also creates a more durable hairstyle in the hair.

The rods 248, however, do not contact the heated barrel 202. The source of the heat is the base plate, not the heated barrel 202. This ensures that hair is not trapped by the device.

Turning to FIG. 9, depicted therein is a top view of the embodiment 200. As can be appreciated from the top view, the base plate 226 encircles the heated barrel. The rods 248 are placed on top of the base plate 226 and heat energy from the base plate 226 is transferred to the rods 248.

Also visible in FIG. 9 is the central rod axis 258 of each rod 248. In one embodiment, the central rod axis 258 of each rod 248 includes an aperture that receives a pin extending substantially perpendicularly away from the base plate 226.

Also visible in FIG. 9 is the top surface 203 of the heated barrel 202. In one embodiment, the top surface 203 comprises an insulating cover, which ensures that the top surface 203 is not as hot as the hairstyling surface of the heated barrel 202.

Figure 10:
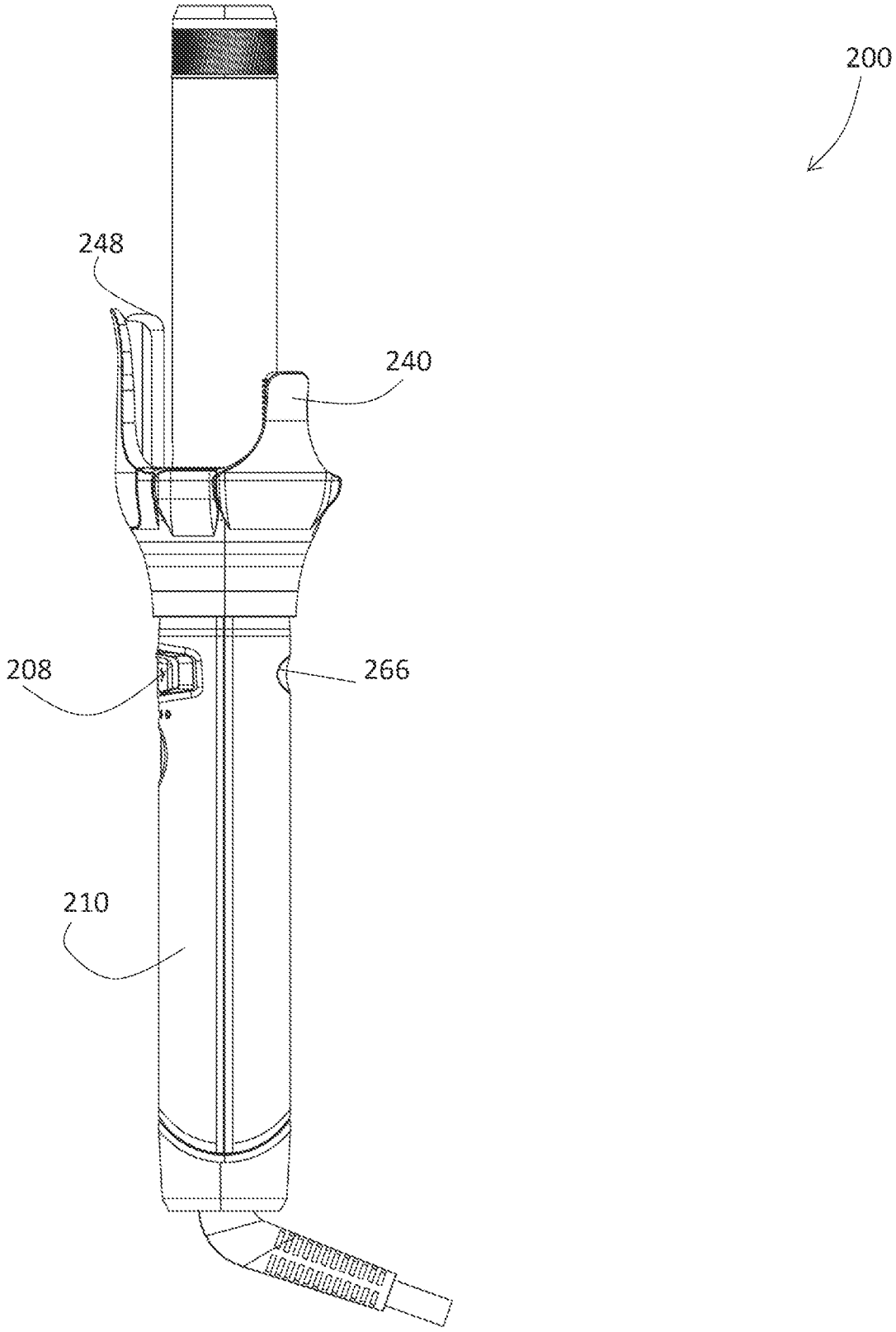
FIG. 10 is a rotated side view of the alternative embodiment.

FIG. 10 depicts the embodiment 200 as rotated around its central axis with a different tab 240 facing the viewer. A finger indentation 266 opposite of the movement buttons 208 on the main body 210 is visible in FIG. 10. The rod 248 of the largest tab 240 is visible in FIG. 10, as well.

Figure 11:
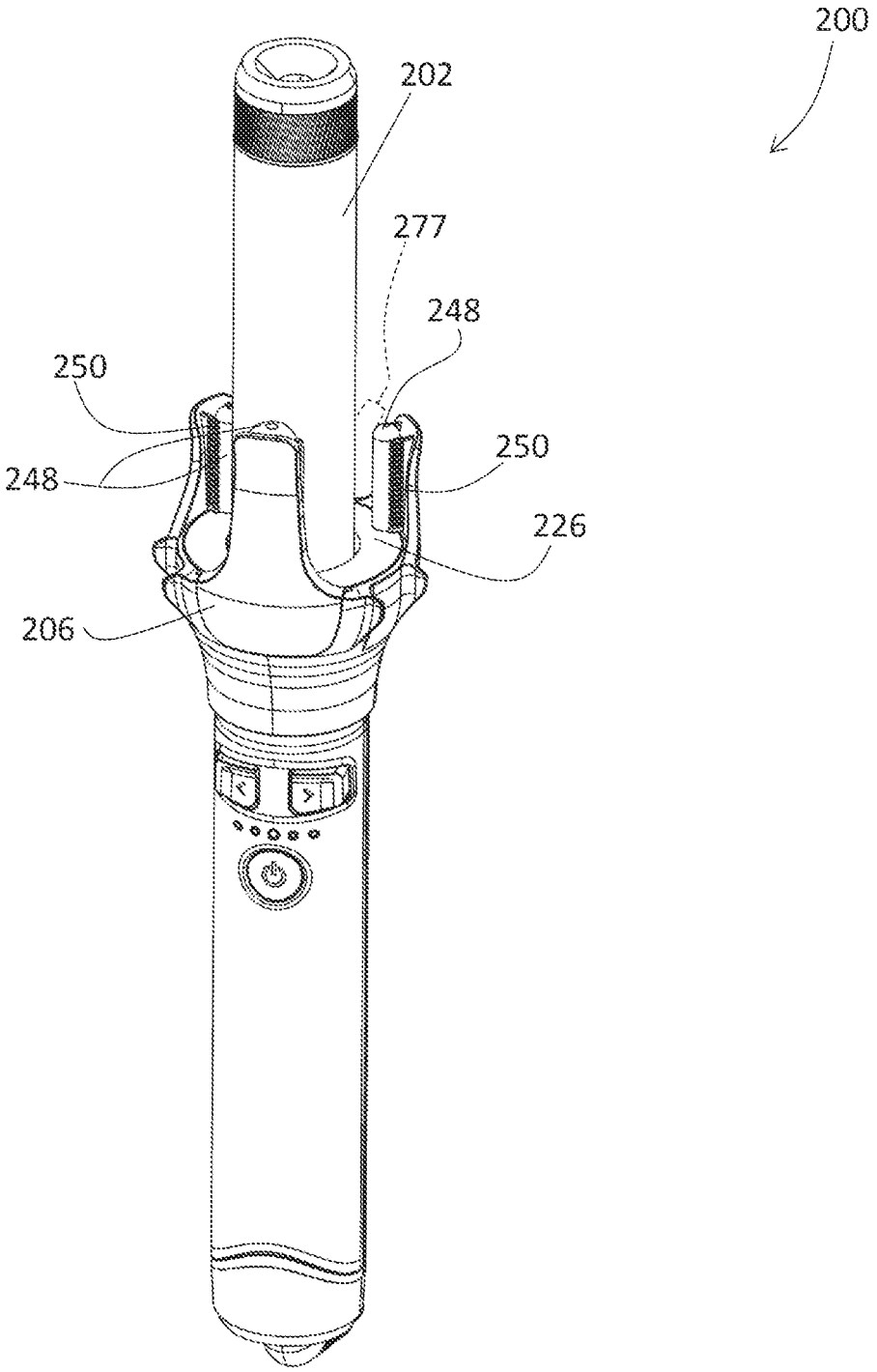
FIG. 11 is an isometric view of the alternative embodiment.

FIG. 11 depicts a front isometric view of the embodiment 200, showing the base plate 226 with the rods 248 installed on the base plate 226. Also visible are the combs 250 associated with each rod 248. As can be appreciated from FIG. 11, a space 277 exists between the rod 248 and the heated barrel 202.

As can be appreciated from FIG. 11, the rotating member 206 includes at least one indentation 217 adapted to receive a holder, such as a wall mount (not pictured).

Figure 12:
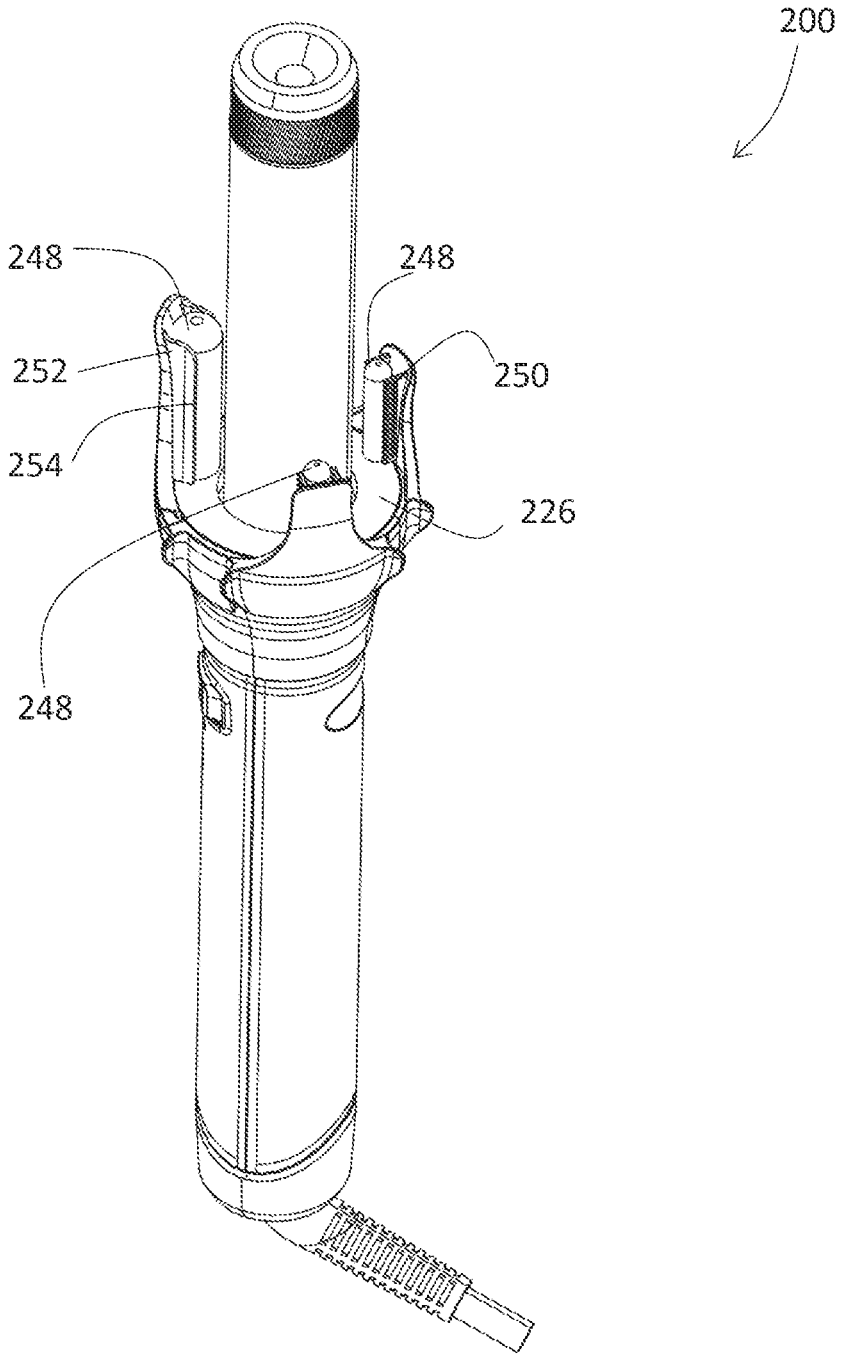
FIG. 12 is a rotated isometric view of the alternative embodiment.

FIG. 12 depicts the embodiment 200, which has again been rotated around its axis. Depicted in FIG. 12 are the base plate 226, the rods 248, the combs 250. As can be appreciated in FIG. 12, the largest rod 248 is not surrounded by combs, but rather a holder 252, that holds the largest rod 248 in place. The holder 252 includes walls that flare out 254 in the direction of the heated barrel 202, but are closer together near the tab 240, thereby squeezing the rod 248 and keeping it in place.

In one embodiment, the rods 248 are removable so as to be cleaned. In another embodiment, the combs 250 and the holder 252 are sufficiently pliable that a cleaning apparatus, such as a brush, can clean their respective surfaces.

In one embodiment, the heating element includes a special cleaning mode that heats up the apparatus's components to facilitate a type of self-cleaning cycle.

Figure 13A:
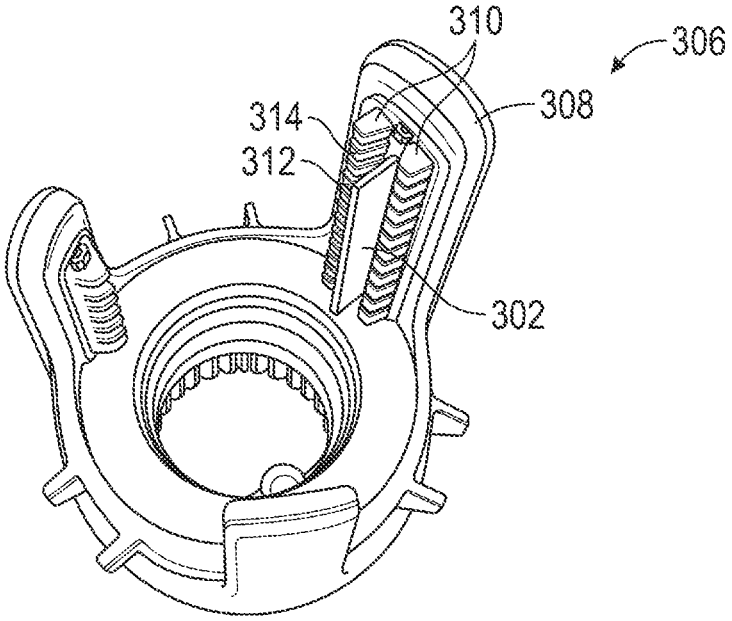
FIG. 13A is a view of a component used in one embodiment of the invention.

FIG. 13A depicts another embodiment of a rotating member 306. The rotating member 306 includes an additional hairstyling element received by one of the tabs 308. In the depicted embodiment, a comb 302 is installed in at least one of the tabs 308. The comb 302 is received between two protrusions 310 having one or more channels 312 and rounded bumps 314. In one embodiment, the comb 302 is removable and replaceable by an end user. The comb 302 comprises a flexible material. In one embodiment, the comb 302 uses a mix of a silicone and a polymer, or silicone alone. In the depicted embodiment, the comb 302 engages frictionally with the protrusions 310 in one of the tabs 308. In another embodiment, not shown, the comb 302 is integrally molded with one of the tabs.

Figure 13B:
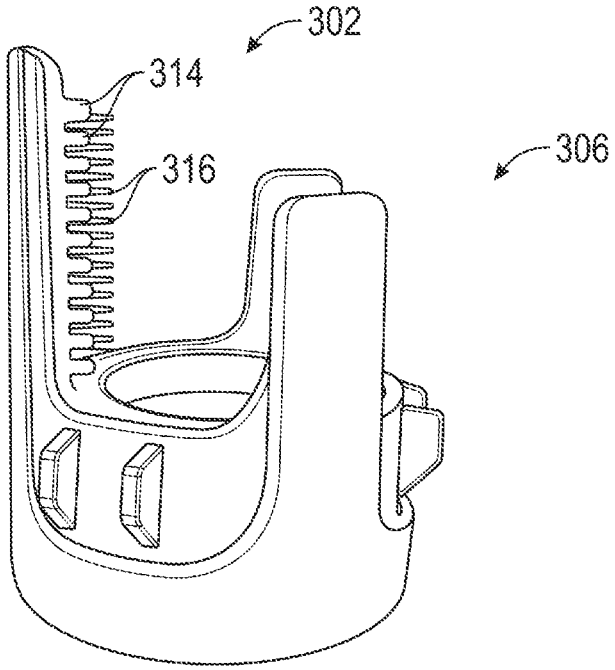
FIG. 13B is another view of a component used in one embodiment of the invention.

As can be appreciated from the side view of FIG. 13B, the comb 302 comprises comb teeth 316 extending beyond the rounded bumps 314.

The combination of the comb 302, the one or more channels 312 and the rounded bumps 314 is adapted to separate and direct hair towards the heated barrel (not shown) without tangling the hair.

Figure 14A:
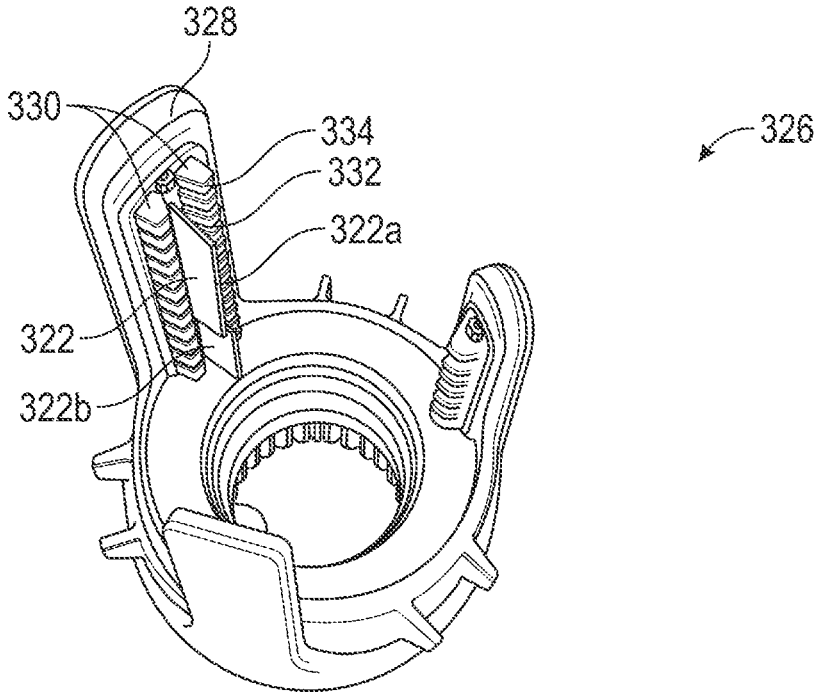
FIG. 14A is a view of a component used in one embodiment of the invention.

Another embodiment of the rotating member 326 is shown in FIG. 14A. The rotating member 326 also includes at least one tab 328 having a flexible blade 322 installed therein as an additional hairstyling element received in at least one tab 328. The flexible blade 322 is adapted to replace the comb 302, in some embodiments. The flexible blade 322 is received between two protrusions 330 which include one or more channels 332 and rounded bumps 334.

In one embodiment, the flexible blade 322 comprises a single piece. In another embodiment, the flexible blade 322 comprises multiple segments, such as a first segment 322*a* and a second segment 322*b* shown in FIG. 14A. (Likewise, the comb 302 can also comprise multiple segments.) In one embodiment, the flexible blade 322 uses a mix of a silicone and a polymer, or silicone alone.

Figure 14B:
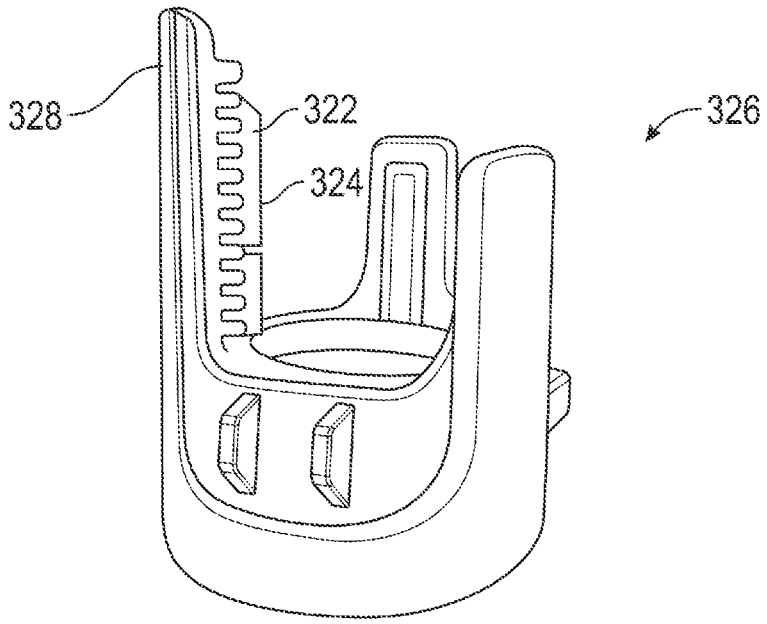
FIG. 14B is another view of a component used in one embodiment of the invention.

As visible in the side view of FIG. 14B, the flexible blade 322 extends a substantial portion of the total height of at least one tab 328. As shown in the drawings, the flexible blade 322 has a tapered shape with one length 324 shorter than the length of the flexible blade 322 installed within at least one tab 328.

The flexible blade 322 cooperates with the tab 328 to direct the hair towards the heated barrel (not shown) without applying excessive pressure since the flexible blade 322 is reversibly deformable and has a lower hardness than hair being manipulated by the device.

Figure 15:
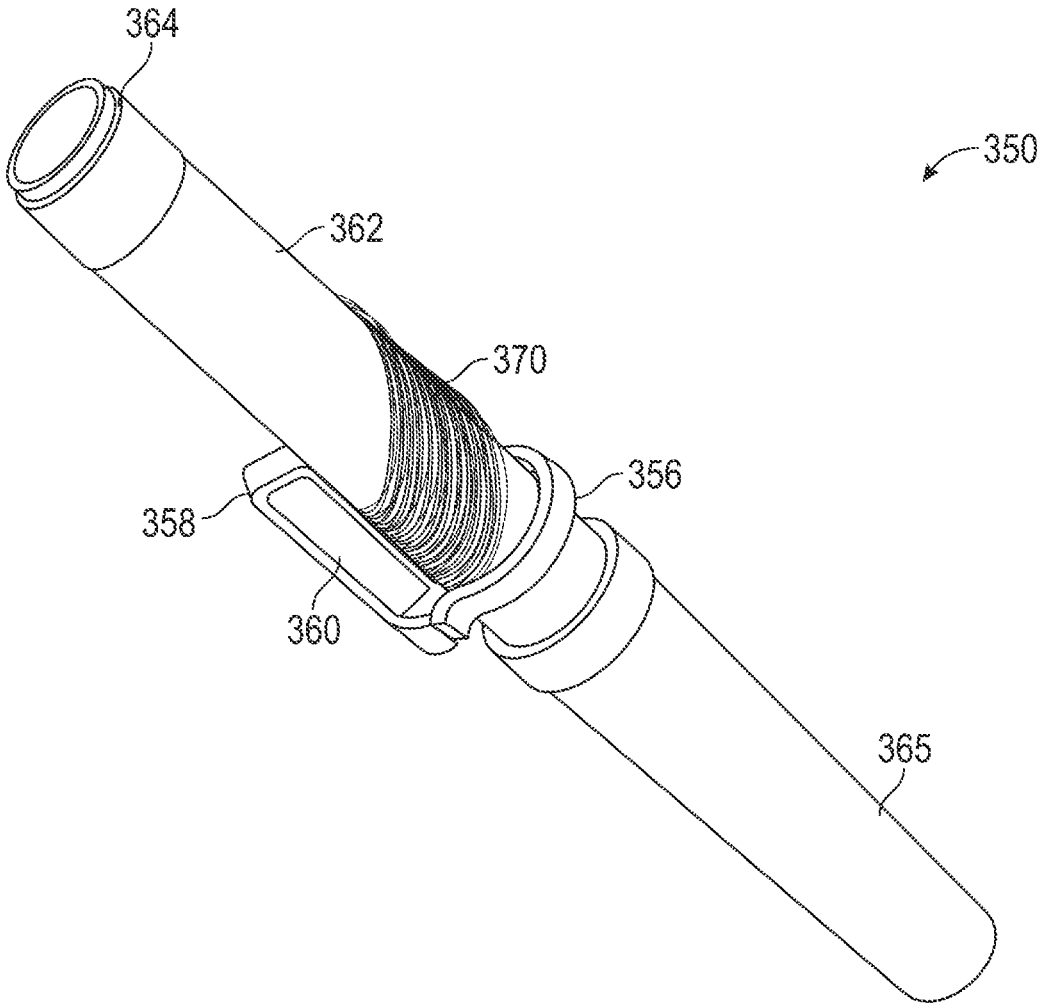
FIG. 15 is an overview of another embodiment of the invention.

A further embodiment 350 is shown in FIG. 15. In that embodiment, the rotating member 356 comprises only one tab 358. The tab 358 includes one or more combs 360, such as the silicon combs discussed herein. The tab 358 and the comb 360 direct the hair 370 towards the hairstyling surface 362 of the heated barrel 364. As was the case with other embodiments, the heated barrel 364 extends from the main body 365, in one embodiment.

Figure 16A:
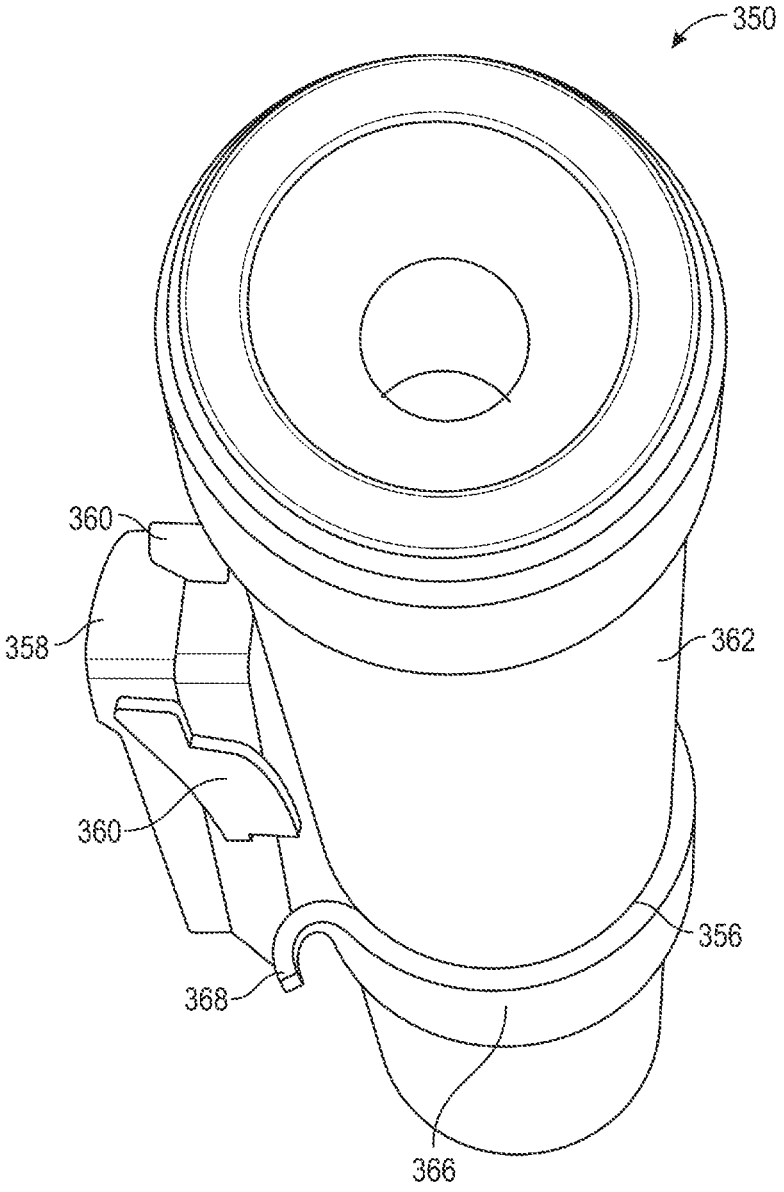
FIG. 16A is an additional view of another embodiment of the invention.

FIG. 16A is another view of the embodiment 350. Visible in FIG. 16A is the rotating member 356 and the tab 358 having the comb 360. A second comb 361 is also partially visible in FIG. 16A.

As can be appreciated from the view of FIG. 16A, the rotating member 356 includes a rounded segment 366 which follows the profile of the hairstyling surface 362. The rounded segment is continuous, but terminates in a first hook 368 at the location of the tab 358. The second hook is not visible in FIG. 16A. In this way, the rotating member includes a semi-circular rounded segment 366 and at least a first hook 368 in proximity to the single tab 358.

Figure 16B:
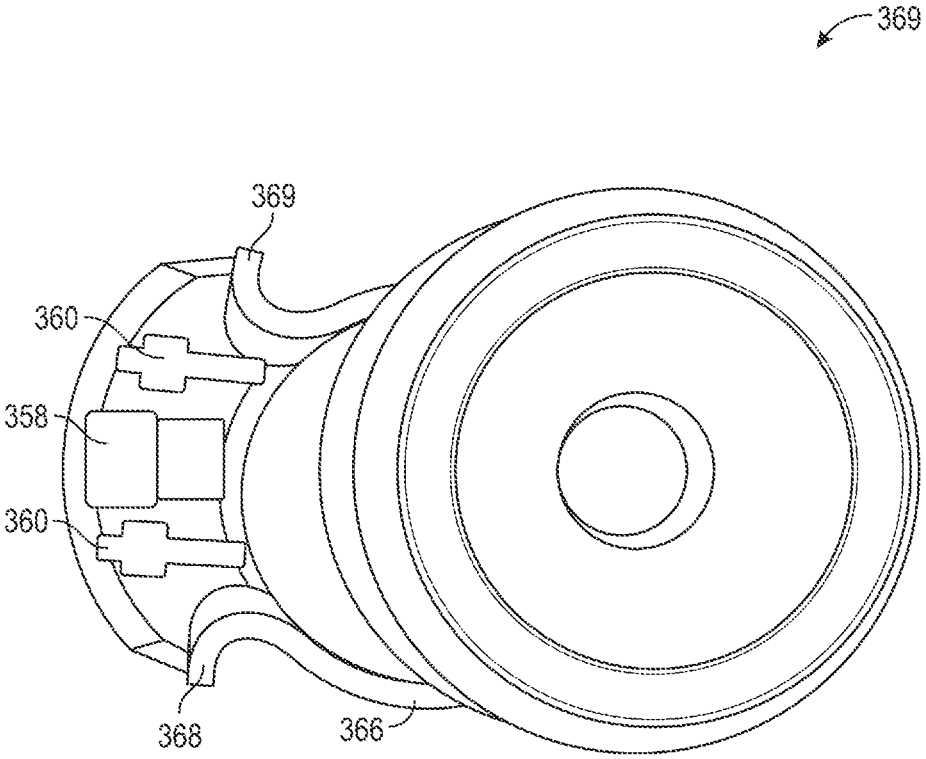
FIG. 16B is a detailed view of another embodiment of the invention.

FIG. 16B is a top view of the embodiment 350 showing the first hook 368 and the second hook 369. The two hooks are formed from the rounded segment 366 as the rounded segment 366 approaches the tab 358. Also visible in FIG. 16B are the two combs 360, 361.

While the rounded segment 366 and the first hook 368 and the second hook 369 are shown in the drawings as separate elements, this is for clarity only. In use, the rounded segment 366 along with the first hook 368 and the second hook 369 comprise one continuous part of the rotating member 356 and may not be visible as separate elements.

A benefit of the embodiment 350 is the use of only one tab 358, which decreases the possibility of hair entanglement. With multiple protrusions, hair being directed to the hairstyling surface 362 can be tangled. The single tab 358 which includes the combs 360, 361 provides sufficient guidance to direct the hair to the hairstyling surface 362 without entanglement.

The use of only one tab 358 also decreases the overall size and weight of the embodiment 350, making the device more portable. In one embodiment, the main body 365 (shown in FIG. 15) includes a battery pack and the embodiment 350 is adapted to operate as a cordless hairstyling device.

Figure 16C:
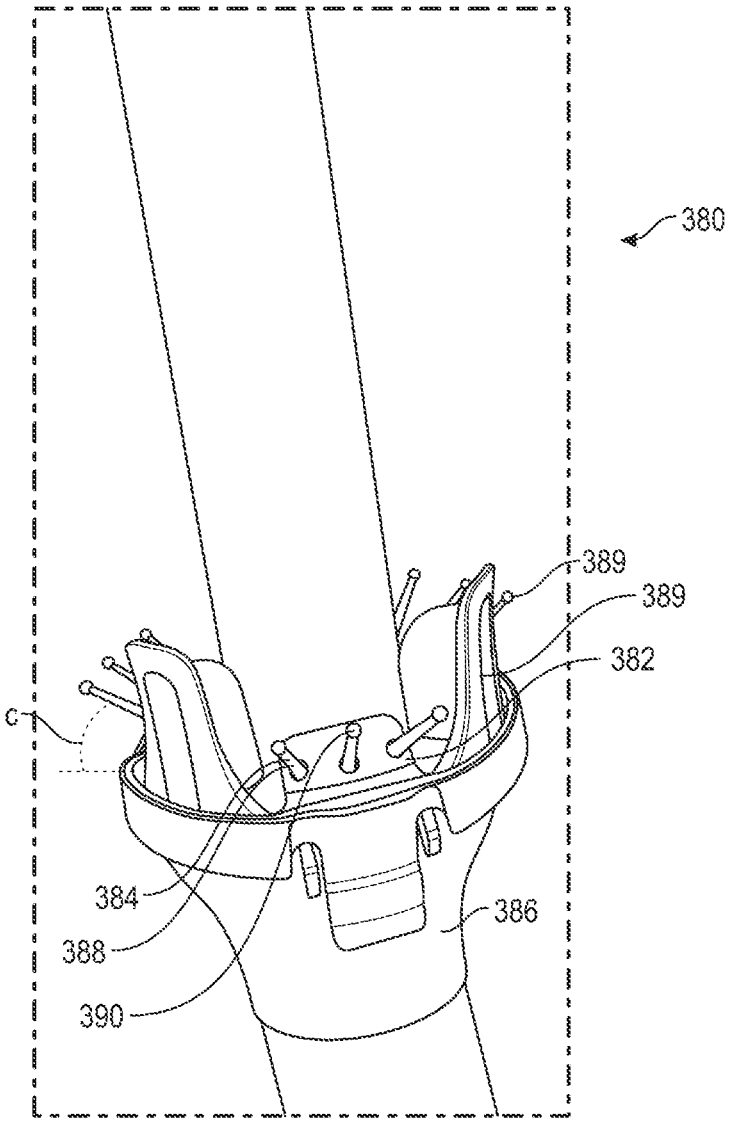
FIG. 16C is an overview of another embodiment of the invention.

A prong-bristle embodiment 380 is shown in FIG. 16C. In addition to tabs 389, the rotating member 386 includes modules 382 for bristles 384. In one embodiment, the rotating member 386 includes at least one set of bristles 384 in a module 382. Each bristle 384 includes a prong 388 and a cushion 390. The bristles 384 are adapted to assist in directing hair towards the styling surface and away from the rotating member 386. The bristles 384 are positioned at an angle c with respect to the edge of the rotating member 386. In one embodiment, the bristles comprise a flexible material.

In the depicted embodiment, the rotating member 386 includes three tabs 389 and also three modules 382. Each module 382 includes three bristles 384. In at least one embodiment, at least one of the modules 382 is removable so that the rotating member 386 can be customized with different accessories.

In some embodiments, both the prong 388 and the cushion 390 comprise the same plastic material. In other embodiments, the cushion 390 comprises an anti-static material. In the depicted embodiment, each cushion 390 is shown as substantially spherical and about 50% wider than the supporting prong 388. In at least some embodiments, each prong 388 tapers towards the cushion so that the prong 388 is thicker at the base and thinner at the cushion end.

Any of the aforementioned embodiments can be used to style hair. The method begins by providing a hairstyling apparatus which includes a barrel defining a hairstyling surface with a rotating member included at one end of the barrel. The rotating member is adapted to rotate around the central axis of the barrel. A heating element inside of the barrel is energized which heats the barrel. Hair is then directed around the barrel and towards the rotating member. The rotating member includes at least one tab and at least one hairstyling tool, each of which redirects the hair. As the hair is exposed to the heated barrel, the hair is curled, achieving a variety of hairstyles.

ADDITIONAL EMBODIMENTS

Figure 17A:
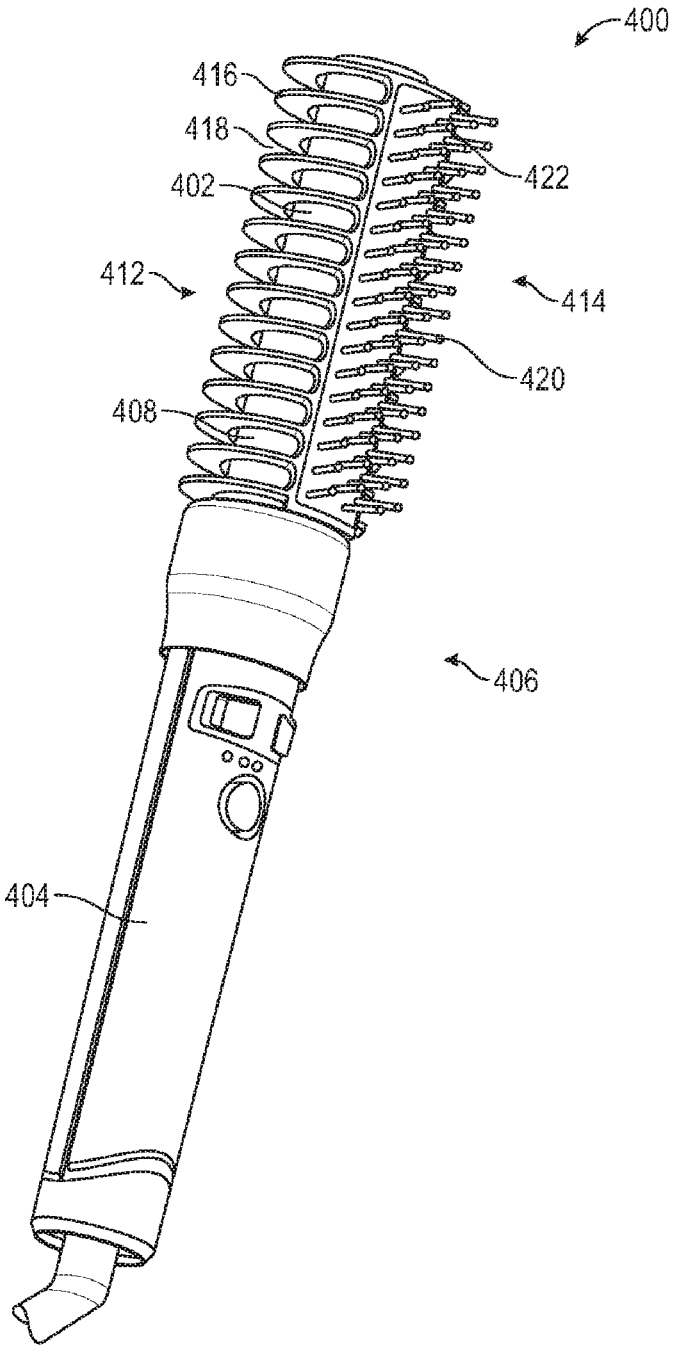
FIG. 17A is an isometric view of a hairstyling apparatus according to an additional embodiment.
Figure 17B:
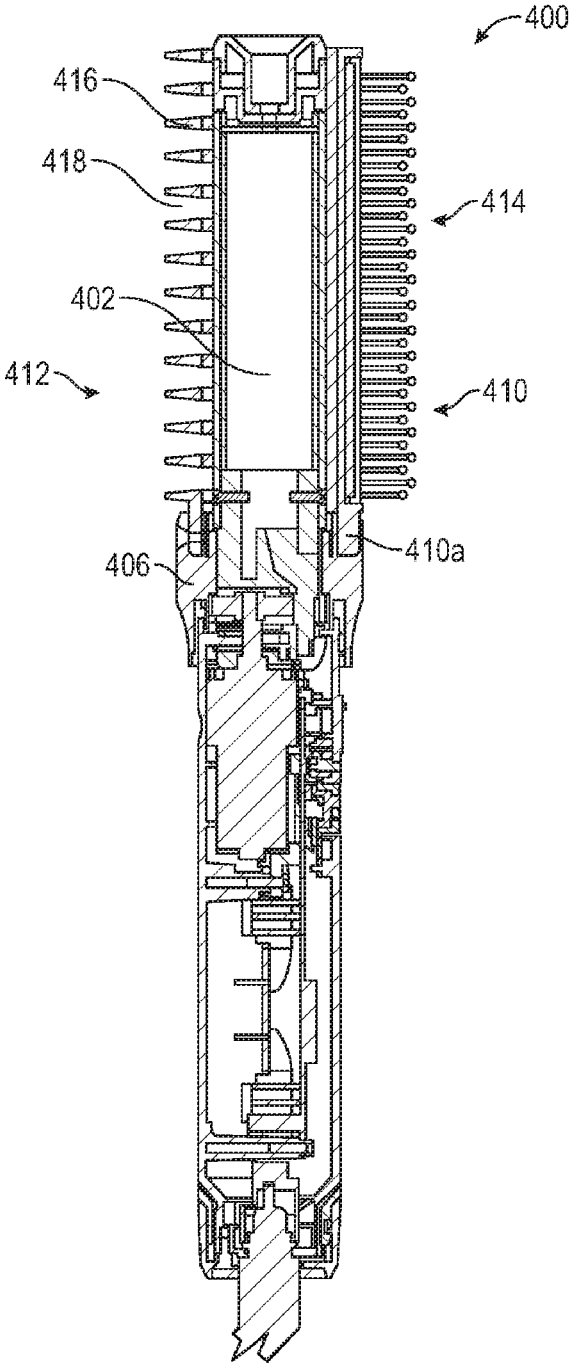
FIG. 17B is a cross sectional view of the hairstyling apparatus according to an additional embodiment.
Figure 17C:
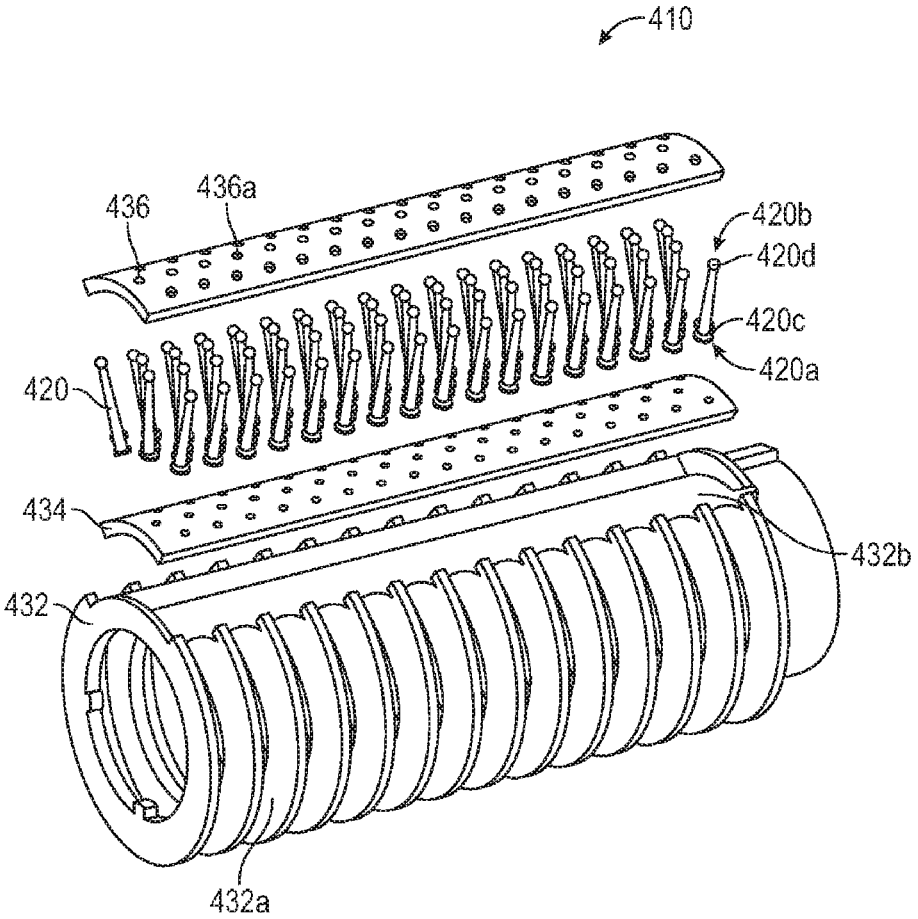
FIG. 17C is an exploded isometric view of a hairstyling tool in the hairstyling apparatus according to an additional embodiment.

FIG. 17A-17C depict a hairstyling apparatus 400 according to another embodiment. FIG. 17A is an isometric view of a hairstyling apparatus 400 according to one embodiment. FIG. 17B is a cross-sectional view of the hairstyling apparatus 400. FIG. 17C is an exploded isometric view of a hairstyling tool in the hairstyling apparatus, according to one embodiment Similar to the aforementioned embodiments, the hair styling apparatus 400 includes a barrel 402, including a hairstyling surface 408 that can be heated, a handle 404 coupled to the barrel 402, and a rotating member 406 that is adapted to rotate around the central axis of the barrel 402.

As shown in FIGS. 17A and 17B, the rotating member 406 of the present embodiment comprises a hairstyling tool 410 extending along the longitudinal length of the hairstyling surface 408 and configured to rotate around the central axis of the barrel 402. The hairstyling tool 410 includes a grooved portion 412 and a comb portion 414. The grooved portion 412 comprises a plurality of grooves 418 that expose the hairstyling surface 408. In this example, the grooved portion 412 comprises a plurality of annular members, that is, the plates 416 that each extend away from the barrel 402 in the radial direction and partially around the barrel 402 in the circumferential direction. The plates 416 are arranged along the central axis of the barrel 402 in parallel. Thus a plurality of grooves 418 are formed by the spaces between adjacent plates 416. The plurality of plates 416 is arranged along the axial direction of the barrel 402 so as to extend over substantially the length of the hairstyling surface 408 and even the barrel 402. The comb portion 414 extends partially around the barrel 402 in the circumferential direction and extends in the axial direction of the barrel 402 over substantially the length of the barrel 402. In addition, the comb portion 414 comprises a base 422 and a plurality of bristles 420 that are distributed over the base 422 and protrude from the base 422 in a direction away from the barrel 402. In this embodiment, the grooved portion 412 and the comb portion 414 are integral to each other so that they form an overall cylindrical part that surrounds the barrel 402. Specifically, the plates 416 are fixed to the comb portion 414. In the embodiment shown in FIG. 17A, the protrusions 416 are substantially parallel. The plates 416 cover less than one-third of the total surface area of the barrel 402 covered by the grooved portions 412, leaving the majority of the barrel 402 exposed.

The comb portion 414 is elongated and the bristles 420 are distributed over the comb portion, to cover a part of a circumference of the barrel 402, for example, 10%, 20%, or 5%-20%, 5%-30%, 3% to 50% of the circumference. Thus, the comb portion covers 10%, 20%, or 5%-20%, 5%-30%, 3% to 50% of the surface area of the barrel.

In one embodiment, the comb portion 414 and the grooved portion 412 comprise different materials. In this embodiment, the comb portion 414 transfers heat from the barrel 402 at a different rate than the grooved portion 412. In one embodiment, the base of the comb portion 414 is substantially insulating, while the grooved portion 412 provides the heating for the hair being manipulated and styled through the grooves 418.

As shown in FIG. 17B, the rotating member 406 is a sleeve that is rotatable relative to the barrel 402. The hairstyling tool 410 is fixed at the proximal end 410*a* to the rotating member 406 thus may rotate together with the rotating member 406. In one embodiment, the hairstyling tool 410 may be configured to have its elements removable. For example, the comb portion 414 or the grooved portion 412 or both of them may be removable from the hairstyling tool 410. In another embodiment, the hairstyling tool 410 may be removeable or detachable from the hairstyling apparatus. In another embodiment, the comb portion 414 and the grooved portion 412 may be integrally molded and may be made from the same material. In addition, in another embodiment, the hairstyling tool 410 may be removable from the rotating member 406 and be replaced with other hairstyling tools aforementioned.

FIG. 17C is an exploded isometric view of the hairstyling tool 410 according to one embodiment that illustrates the assembly of the hairstyling tool 410. As shown in FIG. 17C, the hairstyling tool 410 includes a main body 432, a comb fixing plate 434, the plurality of bristles 420, and comb cover plate 436. The main body 432 comprises a plurality of plates

432*a* that are fixed to an elongated portion 432*b*. The plates 432*a* are annular and spaced from each other. Therefore, the plates 432*a* form the protrusions 416 and the spaces between adjacent plates 432*a* form the grooves 418.

The elongated portion 432*b* thus forms the base portion of the comb portion 414. Specifically, the bristles 420 are fixed to the comb fixing plate 434, which in turn is fixed to the elongated portion 432*b*. The comb cover plate 436 is perforated with a plurality of through holes 436*a* that correspond to the respective bristles 420. The comb cover plate 436 is fixed to the comb fixing plate 434, with each of the bristles 420 passing through the corresponding through holes 436*a*. As shown in FIG. 17C, each bristle 420 includes a proximal end 420*a* that is fixed to the comb fixing plate 434 and a free distal end 420*b*. An expanded portion 420*c* is provided around the proximal end 420*a*. The expanded portion 420*a* is wider than the diameter of the through hole 436*a*. Therefore, the comb cover plate 436 reinforces the fixture of the bristles 420 to the comb fixing plate 434. In addition, the distal end 420*b* of the bristle 420 may include a rounded portion 420*d*. The rounded portion 420*d* may, for example, prevent the skull of the user from being hurt by an otherwise acute end of the bristles. The embodiment shown in FIG. 17C is exemplary. For example, in another embodiment, the comb fixing plate may be omitted, and the bristles may be fixed to the elongated portion directly with the comb cover plate fixed to the elongated portion. In yet another embodiment, the bristles may be formed integrally with the elongated portion. In yet another embodiment, the bristles may be tapered from the proximal end towards the distal end, or in another shape, as long as the proximal end is wider than a diameter of the corresponding through hole.

In this embodiment, the grooved portion 412 and comb portion 414 are fixed to each other and form an overall cylindrical hairstyling tool that is rotatable around the axis of the barrel 402. In addition, the inner diameter of the hairstyling tool is slightly larger than the diameter of the barrel 402 thus the groove portion 412 and the comb portion 414 keep a distance from the barrel 402.

Figure 18:
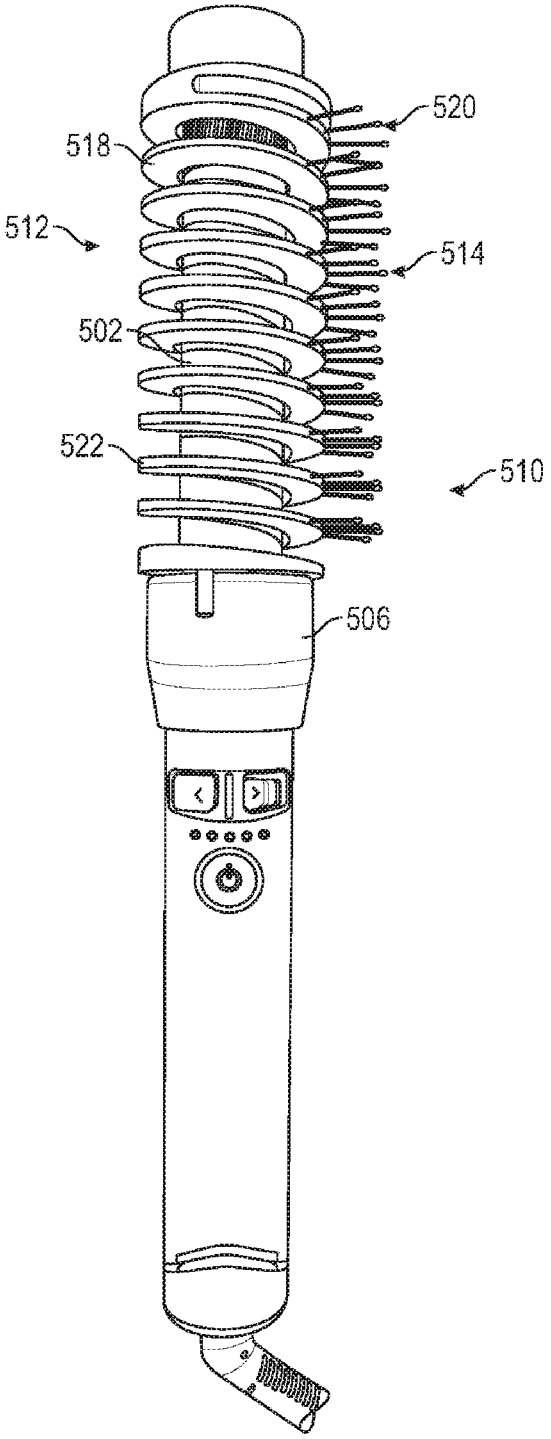
FIG. 18 is an isometric view of a hairstyling apparatus according to an alternative embodiment.

FIG. 18 depicts an alternative embodiment of the hairstyling tool 510. As shown in FIG. 18, the hairstyling tool 510 is rotatable around the central axis of the barrel 502 and extends substantially the length of the barrel 502 in the axial direction and around the barrel 502 in the circumferential direction. The hairstyling tool 510 includes a grooved portion 512 and a comb portion 514. The grooved portion 512 comprises a spiral portion 522 that winds around the hairstyling surface in a form of spiral. The spaces between the respective turns of the spiral portion 522 forms the grooves 518. In addition, a plurality of bristles 520 is distributed and fixed to the spiral portion 522. The bristles 520 are distributed in the same section in the circumferential direction of each turn of the spiral portion 522 and distributed along the axial direction, thus creating an elongated comb portion 514.

There may be made various modifications and alternatives to the embodiments shown in FIGS. 17A-C and 18. For example, the rotating member may include additional components such as the tabs and styling tools as aforementioned by referring to FIGS. 1-16. In the embodiments shown in FIGS. 17A-C and 18, the comb portion and the grooved portion extend substantially the length of the hairstyling surface. However, in another embodiment, either or both of the comb portion and the grooved portion may extend over a portion of the length of the barrel, such as, from 10% to 90% of the length, from 20% to 90% of the length, from 30% to 90% of the length. In another embodiment, the comb portion and the grooved portion may eve extend beyond the length of hairstyling surface or the length of the barrel. In this case, the hairstyling tool including the comb portion and the grooved portion may also prevent the hairstyling surface from directly touching user's skull and skin thus prevent user from getting burned. In yet another embodiment, the grooved portion and the comb portion may not necessarily be fixed directly or integral to each other. The grooved portion and the comb portion may be separately formed and configured to be rotatable around the axis of the barrel by, for example, being fixed to the same or different rotating member. In yet another embodiment, the grooved portion and the comb portion may not surround completely the barrel and just partially surround the barrel in the circumferential direction. In yet another embodiment, either or both of the grooved portion and the comb portion may comprise a plurality of sections that are distributed in either or both of the axial direction and circumferential direction. In this case, the respective sections of the grooved portion or the comb portion may be evenly or unevenly distributed. In yet another embodiment, the rotating member may be provided at another location than that between the barrel and the handle. For example, the cool tip of the barrel may be configured as rotatable around the axis of the barrel, and the comb portion and the grooved portion may be fixed to the cool tip. In yet another embodiment, the rotating member may not be provided, and the hairstyling tool may be driven directly by the motor and function as the rotating member.

The hairstyling apparatus aforementioned by referring to FIGS. 17A-C and 18 can be used to style hair in various ways. For example, the user may curl their hair with the hairstyling apparatus. The user may position the hairstyling apparatus against their hair similarly as depicted in FIG. 5. The user may then cause head hair to be placed at the hairstyling tool either by the action of gravity or manually, or by turning on the hairstyling apparatus and causing the rotating member to rotate. By keep rotating the rotating member, the comb portion will catch the hair so as to wind the hair around the hairstyling surface. The hair will then be divided into strands by the protrusions of the grooved portion. As the hair is wrapped around the hairstyling surface, the hair may be curled while volume is increased. In another example, the user may just position the hairstyling apparatus against their hair, closer to the root of the hair, and rotate the rotating member while pulling the hairstyling apparatus towards the free end of the hair, to increase the volume of their hair. In short, the method begins by providing a hairstyling apparatus that includes a barrel defining a hairstyling surface with a rotating member included at one end of the barrel. The rotating member is adapted to rotate around the central axis of the barrel. A heating element inside of the barrel is energized, which heats the barrel. Hair is then directed around the barrel and towards the rotating member. The hairstyling apparatus includes a grooved portion and a comb portion that are rotatable around the central axis of the barrel, each of which redirects the hair. As the hair is exposed to the heated barrel, the hair is curled, achieving a variety of hairstyles.

Figure 19A:
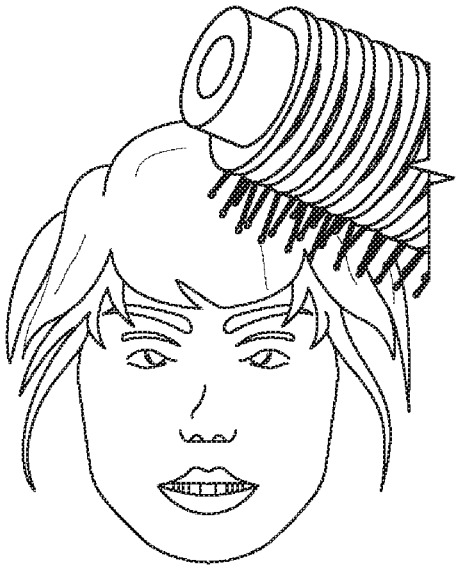
FIGS. 19A-D show the steps of using an embodiment.
Figure 19B:
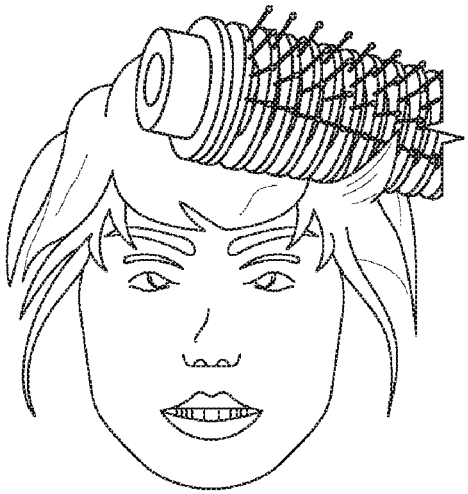
Figure 19C:
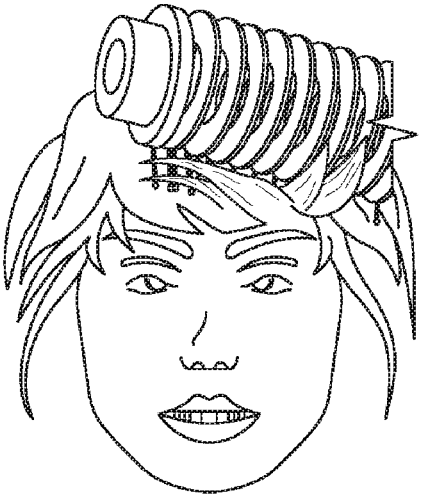
Figure 19D:
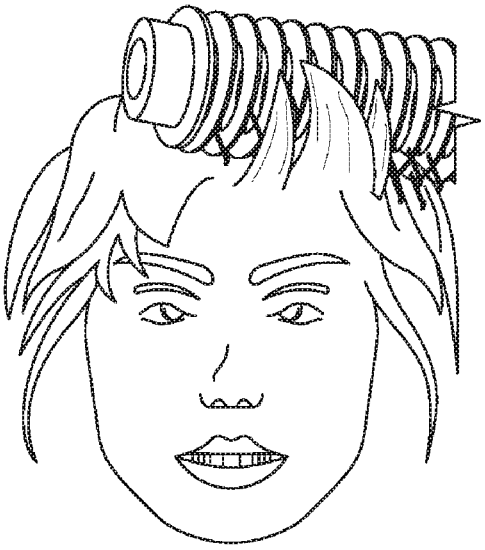

FIGS. 19A-D show the different stages of styling hair using an embodiment such as the hairstyling tool 510 shown in FIG. 18. As shown in FIG. 19A, the styling tool is brought near the hair to be styled with the bristles positioned towards the hair to be styled. The hairstyling tool is then engaged to begin rotating, while close enough to collect at least some of the hair. The hair is engaged by the bristles and styled around the partially-covered barrel, as shown in FIG. 19B. The hairstyling tool is then moved upwardly, in the same direction as the rotation or in the opposite direction as the rotation depending on user's preference. As shown in FIG. 19C, during the rotation, more hair is collected and contacts the barrel. The tool then keeps moving, as shown in FIG. 19D until completing the rotation, with the bristles again positioned towards the hair. In another example, the user may also initially position the hairstyling tool close to their face or skull and brush the hair downwards while the hairstyling tool is rotating. Therefore, the movement of the bristles may create curls that create volume appearance of the hair.

The hair is therefore styled by adding lift and increasing volume as well as imparting a curl to the hair, without exposing the hair to an undue amount of heat.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

The embodiments of the invention in which an exclusive property or privilege is claimed is defined as follows:

1. A hairstyling apparatus comprising:

a barrel which includes a hairstyling surface and a longitudinal central axis, wherein the barrel has a proximal end and a distal end;

a heating element in thermal communication with the barrel; and a hairstyling tool extending along a longitudinal length of the hairstyling surface and configured to rotate around the central axis of the barrel, the hairstyling tool including a comb portion comprising a plurality of bristles that protrude in a direction away from the hairstyling surface and a grooved portion comprising a plurality of grooves that extend in a circumferential direction of the barrel and expose the hairstyling surface; wherein, the comb portion comprises a base portion that extends along the longitudinal length of the hairstyling surface, and the plurality of bristles are fixed to the base portion;

the comb portion further comprises a comb fixing plate to which the plurality of bristles are fixed and a comb cover plate comprising perforation defined by a plurality of through holes;

each of the plurality of bristles passes through a corresponding one of the plurality of through holes;

a proximal end of each of the plurality of bristles is larger than a diameter of the corresponding one of the plurality of the through holes; and the comb cover plate is fixed to the comb fixing plate to secure the plurality of bristles to the comb fixing plate.

2. The hairstyling apparatus of claim 1, wherein the grooved portion comprises a plurality of annular members surrounding the barrel that are arranged along the longitudinal length of the hairstyling surface, and a space between adjacent annular members comprises the groove.

3. The hairstyling apparatus of claim 2, wherein the plurality of annular members are fixed to the comb portion.

4. The hairstyling apparatus of claim 1, wherein the hairstyling tool is configured as a cylindrical part that surrounds the barrel, and has an inner diameter larger than a diameter of the barrel thus keeps a distance from the hairstyling surface of the barrel.

5. The hairstyling apparatus of claim 1, wherein the comb portion is elongated and the plurality of bristles are distributed to cover a part of a circumference of the barrel.

6. The hairstyling apparatus of claim 1, wherein the hairstyling tool extends along substantially the longitudinal length of the hairstyling surface.

7. The hairstyling apparatus of claim 1, further comprising a rotating member configured to rotate around the central axis of the barrel, and the hairstyling tool is fixed to the rotating member to rotate around the central axis of the barrel together with the rotating member.

8. The hairstyling apparatus of claim 7, wherein the rotating member is located at the proximal end of the barrel.

9. The hairstyling apparatus of claim 1, wherein a distal end of each of the plurality of bristles is rounded.

10. The hairstyling apparatus of claim 1, wherein said grooved portion comprises substantially parallel plates.

11. The hairstyling apparatus of claim 1, wherein said comb portion is elongated along a length of the barrel.

12. The hairstyling apparatus of claim 1, wherein at least one of the comb portion and the grooved portion is removable from the hairstyling tool.

13. A hairstyling apparatus comprising:

a barrel which includes a hairstyling surface and a longitudinal central axis, wherein the barrel has a proximal end and a distal end;

a heating element in thermal communication with the barrel; and a hairstyling tool extending along a longitudinal length of the hairstyling surface and configured to rotate around the central axis of the barrel, the hairstyling tool including a comb portion comprising a plurality of bristles that protrude in a direction away from the hairstyling surface and a grooved portion comprising a plurality of grooves that extend in a circumferential direction of the barrel and expose the hairstyling surface;

wherein the grooved portion comprises a spiral portion that winds around the hairstyling surface in a form of spiral.

14. The hairstyling apparatus of claim 13, wherein the comb portion is configured by the plurality of bristles fixed to the spiral portion.

15. The hairstyling apparatus of claim 13, wherein the hairstyling tool is configured as a cylindrical part that surrounds the barrel, and has an inner diameter larger than a diameter of the barrel thus keeps a distance from the hairstyling surface of the barrel.

16. The hairstyling apparatus of claim 13, wherein the comb portion is elongated and the plurality of bristles are distributed to cover a part of a circumference of the barrel.

17. The hairstyling apparatus of claim 13, wherein the hairstyling tool extends along substantially the longitudinal length of the hairstyling surface.

18. The hairstyling apparatus of claim 13, further comprising a rotating member configured to rotate around the central axis of the barrel, and the hairstyling tool is fixed to the rotating member to rotate around the central axis of the barrel together with the rotating member.

19. The hairstyling apparatus of claim 18, wherein the rotating member is located at the proximal end of the barrel.

20. The hairstyling apparatus of claim 18, wherein the hairstyling tool is removable from the rotating member.

* * * * *